US011735079B2

(12) United States Patent
Hwang et al.

(10) Patent No.: US 11,735,079 B2
(45) **Date of Patent: *Aug. 22, 2023**

(54) DISPLAY DRIVING CIRCUIT INCLUDING CRACK DETECTOR AND DISPLAY DEVICE INCLUDING THE DISPLAY DRIVING CIRCUIT

(71) Applicant: Samsung Electronics Co., Ltd., Suwon-si (KR)

(72) Inventors: Jinhong Hwang, Gwacheon-si (KR); Siwoo Kim, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 17/824,568

(22) Filed: May 25, 2022

(65) Prior Publication Data

US 2022/0284841 A1 Sep. 8, 2022

Related U.S. Application Data

(63) Continuation of application No. 17/060,719, filed on Oct. 1, 2020, now Pat. No. 11,355,039.

(30) Foreign Application Priority Data

Mar. 2, 2020 (KR) ..... 10-2020-0026132

(51) Int. Cl.
*G09G 3/00* (2006.01)
*G09G 3/20* (2006.01)

(52) U.S. Cl.
CPC ..... *G09G 3/006* (2013.01); *G09G 3/20* (2013.01); *G09G 2330/12* (2013.01)

(58) Field of Classification Search
USPC ..... 345/204
See application file for complete search history.

(56) References Cited

U.S. PATENT DOCUMENTS

| | | | | |
|---|---|---|---|---|
| 5,184,516 | A | 2/1993 | Blazic et al. | |
| 5,442,612 | A | 8/1995 | Takeuchi et al. | |
| 5,723,875 | A | 3/1998 | Abe et al. | |
| 6,649,986 | B1 | 11/2003 | Ishizaki et al. | |
| 6,686,750 | B2 | 2/2004 | Watanabe et al. | |
| 8,510,061 | B2 | 8/2013 | Grant et al. | |
| 9,287,184 | B2 | 3/2016 | Dennison et al. | |
| 9,768,129 | B2 | 9/2017 | Lee et al. | |
| 11,355,039 | B2 * | 6/2022 | Hwang | G09G 3/006 |
| 2015/0115266 | A1 | 4/2015 | Sanchez et al. | |
| 2017/0125360 | A1 | 5/2017 | Lee et al. | |
| 2017/0323835 | A1 | 11/2017 | Ogawa et al. | |
| 2018/0342185 | A1 | 11/2018 | Lee et al. | |
| 2019/0066595 | A1 | 2/2019 | Kim et al. | |

* cited by examiner

*Primary Examiner* — Ifedayo B Iluyomade
(74) *Attorney, Agent, or Firm* — Muir Patent Law, PLLC

(57) ABSTRACT

A display driving circuit includes a central area and a boundary area surrounding the central area. The display driving circuit includes a first crack detector circuit in the central area; and a first crack sensing line in the boundary area, wherein the first crack detector circuit is configured to detect a crack in the first crack sensing line in response to a first test command, and output a test result signal including information about a presence or an absence of a crack in the first crack sensing line.

20 Claims, 16 Drawing Sheets

DISPLAY DRIVING CIRCUIT INCLUDING CRACK DETECTOR AND DISPLAY DEVICE INCLUDING THE DISPLAY DRIVING CIRCUIT

CROSS-REFERENCE TO RELATED APPLICATION

This application is a continuation application of U.S. patent application Ser. No. 17/060,719, filed Oct. 1, 2020, which claims the benefit of priority to Korean Patent Application No. 10-2020-0026132, filed on Mar. 2, 2020 in the Korean Intellectual Property Office, the disclosure of which is incorporated herein in its entirety by reference.

BACKGROUND

The inventive concept relates to a semiconductor device, and more particularly, to a display driving circuit driving a display panel to display an image thereon, a display device including the display driving circuit, and a crack detection circuit included therein.

A display device includes a display panel for displaying an image and a display driving circuit for driving the display panel. The display driving circuit may drive the display panel by receiving image data from an external host and applying an image signal corresponding to the received image data to a data line of the display panel.

Most semiconductor integrated circuits (ICs), such as those included in a display driving circuit, are prone to cracking. The cracking may be due to external forces, such as cracks that occur during a sawing process or during impact after shipment. These cracks can cause defects in modules or sets. In particular, cracks that form in DDI (Display Driver IC), and cracks that occur when assembling modules in the form of COG (Chip On Glass), COP (Chip On Plastic), or COF (Chip On Film) may occur and defects caused by this may not be recognized until after the crack occurs. Therefore, a system and method for detecting these cracks is particularly useful.

SUMMARY

Aspects of the inventive concept provide a display driving circuit that detects a crack, and a display device.

According to an aspect of the inventive concept, a display driving circuit includes a central area and a boundary area surrounding the central area. The display driving circuit includes: a first crack detector circuit arranged in the central area and configured to detect a crack in the display driving circuit and output a test result signal; and a first crack sensing line in the boundary area. The first crack detector is configured to transmit a first test signal to a first end of the first crack sensing line, receive a first reception signal from a second end of the first crack sensing line, and output the test result signal according to a result of comparing the first test signal with the first reception signal.

According to another aspect of the inventive concept, a display driving circuit includes a central area and a boundary area surrounding the central area. The display driving circuit includes a first crack detector circuit in the central area; and a first crack sensing line in the boundary area, wherein the first crack detector circuit is configured to detect a crack in the first crack sensing line in response to a first test command, and output a test result signal including information about a presence or an absence of a crack in the first crack sensing line.

According to another aspect of the inventive concept, a display device includes a display panel including a plurality of pixels arranged in rows and columns; and a display driving circuit providing a driving signal to a plurality of data lines connected to the plurality of pixels, and including a crack detector circuit, wherein the crack detector circuit, in response to a test command, detects a crack in the display driving circuit, and outputs a test result signal including information about whether a crack has occurred in the display driving circuit to the outside of the display driving circuit.

BRIEF DESCRIPTION OF THE DRAWINGS

Embodiments of the inventive concept will be more clearly understood from the following detailed description taken in conjunction with the accompanying drawings in which.

DETAILED DESCRIPTION OF THE EMBODIMENTS

Figure 1:
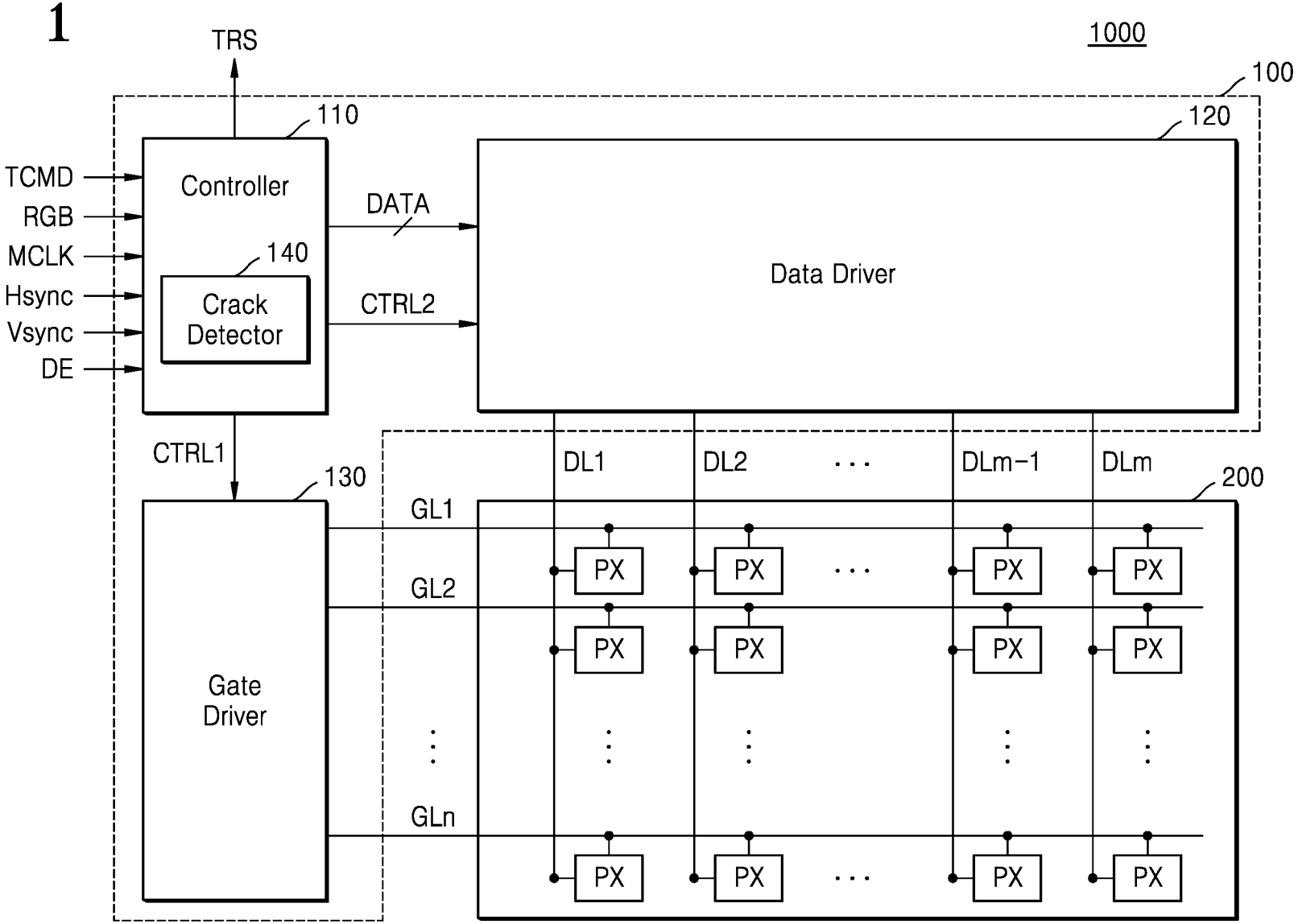
FIG. 1 is a block diagram of a display device according to an example embodiment of the inventive concept.

FIG. 1 is a block diagram of a display device 1000 according to an example embodiment of the inventive concept.

The display device 1000 according to an example embodiment of the inventive concept may be mounted on an electronic device having an image display function. For example, the electronic device may include a smartphone, a tablet personal computer (PC), a portable multimedia player (PMP), a camera, a wearable device, a television, a digital video disk (DVD) player, a refrigerator, an air conditioner, an air purifier, a set-top box, a robot, a drone, various medical devices, a navigation device, a global positioning system (GPS) receiver, an advanced drivers assistance system (ADAS), an automobile device, furniture, various measuring devices, etc.

Referring to FIG. 1, the display device 1000 may include a display driving circuit 100 and a display panel 200, and the display driving circuit 100 may include a controller 110, a data driver 120, and a gate driver 130. However, in some embodiments, the display driving circuit 100 does not include the gate driver 130, and the gate driver 130 may be included in the display device 1000 in a separate configuration from the display driving circuit 100.

In an example embodiment, the display driving circuit 100 and the display panel 200 may be implemented in one module. For example, the display driving circuit 100 may be mounted on a circuit film such as a tape carrier package (TCP), a chip on film (COF), or a flexible print circuit (FPC), and may be attached to the display panel 200, for example by a tape automatic bonding (TAB) method, or may be mounted on a non-display area of the display panel 200 by a chip on glass (COG) or chip on plastic (COP) method.

The display panel 200 may include a plurality of pixels PX arranged in a matrix form, and may display images in units of frames. The display panel 200 may be implemented with one of a liquid crystal display (LCD), a light emitting diode (LED) display, an organic LED (OLED) display, an active-matrix OLED (AMOLED) display, an electrochromic display (ECD), a digital mirror device (DMD), an actuated mirror device (AMD), a grating light valve (GLV), a plasma display panel (PDP), an electro luminescent display (ELD), a vacuum fluorescent display (VFD), or with other types of flat panel displays or flexible displays.

The display panel 200 may include first through $n^{th}$ gate lines GL1 through GLn arranged in a row direction, first through $m^{th}$ data lines DL1 through DLm arranged in a column direction, and the pixels PX formed at crossing points of the first through $n^{th}$ gate lines GL1 through GLn and the first through $m^{th}$ data lines DL1 through DLm. The display panel 200 may include a plurality of horizontal lines (or rows), and one horizontal line may include pixels PX connected to one gate line.

The gate driver 130 may sequentially select the first through $n^{th}$ gate lines GL1 through GLn by sequentially providing a gate-on signal to the first through $n^{th}$ gate lines GL1 through GLn, in response to a first control signal CTRL1 provided by the controller 110. As the first through $n^{th}$ gate lines GL1 through GLn are sequentially selected according to the gate-on signal output from the gate driver 130, and a gradation voltage corresponding to the pixels PX is applied to the pixels PX connected to the selected gate lines via the first through $m^{th}$ data lines DL1 through DLm, a display operation may be performed. In a period in which the gate-on signal is not provided to the first through $n^{th}$ gate lines GL1 through GLn, a gate-off signal (for example, a logic high level gate voltage) may be provided to the first through $n^{th}$ gate lines GL1 through GLn.

The data driver 120 may convert image data DATA into image signals, which are analog signals, in response to a second data control signal CTRL2, and provide the image signals to the first through $m^{th}$ data lines DL1 through DLm. The data driver 120 may include a plurality of channel amplifiers, and each of the plurality of channel amplifiers may provide the image signal to at least one corresponding data line.

The controller 110 may control all operations of the display device 1000. The controller 110 may be implemented in hardware, software, or a combination of hardware and software. For example, the controller 110 may be implemented with digital logic circuits and registers, which perform various functions below.

The controller 110 may receive image data RGB and a control signal (for example, a horizontal synchronization signal, a vertical synchronization signal, a clock signal MCLK, and a data enable signal DE) from the outside of the display driving circuit 100, for example, a main processor of an electronic device having the display device mounted thereon, or an image processing processor, and may generate a control signal (for example, the first control signal CTRL1) and a data control signal (the second control signal CTRL2) for controlling the data driver 120 and the gate driver 130 based on the received signals. In addition, the controller 110 may convert the format of the image data RGB received from the outside of the display driving circuit 100 to meet an interface specification of the data driver 120, and may transmit the converted image data DATA to the data driver 120.

The controller 110 may include a crack detector 140 for detecting cracks occurring in the display driving circuit 100. The display driving circuit 100 may include a central area in which logic circuits are arranged and a boundary area surrounding the central area, and may include a sensing conductive line for detecting cracks formed in the boundary area. The crack detector 140 may detect cracks occurring in display driving circuit 100, for example, by detecting cracks, breaks, displacement, or strains on the sensing conductive line which indicate a crack in the display driving circuit 100.

The crack detector 140 may include hardware and/or software used to detect cracks, and may be referred to herein as a crack detector circuit. The crack detector 140 may receive a test command TCMD from the outside of the display driving circuit 100, perform a crack test operation in response to the test command TCMD, and output a test result signal TRS as a test result. For example, the crack detector 140 may output the test result signal TRS of a first level (for example, a low level) when no crack, or break, has occurred in the sensing conductive line, and may output the test result signal TRS of a second level (for example, a high level) when a crack, or break, has occurred in the sensing conductive line. However, these are examples for convenience of description, and the test result signal TRS may be variously configured.

In an example embodiment, the crack detector 140 outputs a first test result signal including information about an existence of cracks in response to a first test command, and outputs a second test result signal including the first test result signal and location information about crack occurrence in response to a second test command. The crack detector 140 may or may not provide the location information about the crack occurrence to the outside of the display driving circuit 100 according to a command.

In an example embodiment, when it is determined that a crack has occurred in the display driving circuit 100, the controller 110 generates preset control signals (for example, the first gate control signal CTRL1 and the second data control signal CTRL2) and preset image data DATA. The data driver 120 and the gate driver 130 may provide the gate-on signal and the image signal to the display panel 200 according to the preset first and second control signals CTRL1 and CTRL2 and the preset image data DATA, and the display panel 200 may display a crack pattern (for example, CRP in FIG. 14) corresponding to the crack occurrence.

The display driving circuit 100 and the display device 1000 according to an example embodiment of the inventive concept may detect cracks occurring in the boundary area of the display driving circuit 100 by including the crack detector 140, and may provide the test result signal TRS to the outside of the display driving circuit 100 and to the outside of the display device 1000. Accordingly, even after the display driving circuit 100 and the display panel 200 are implemented in a single module, and furthermore, even after the display device 1000 is mounted on an electronic device, the test result signal TRS including information about the crack occurrence of the display driving circuit 100 may be output to the outside of the display driving circuit 100 and to the outside of the display device 1000. When a crack occurs in the display device 1000, a host may determine whether the crack has been generated in the display driving circuit 100 by using the test result signal TRS.

Figure 2:
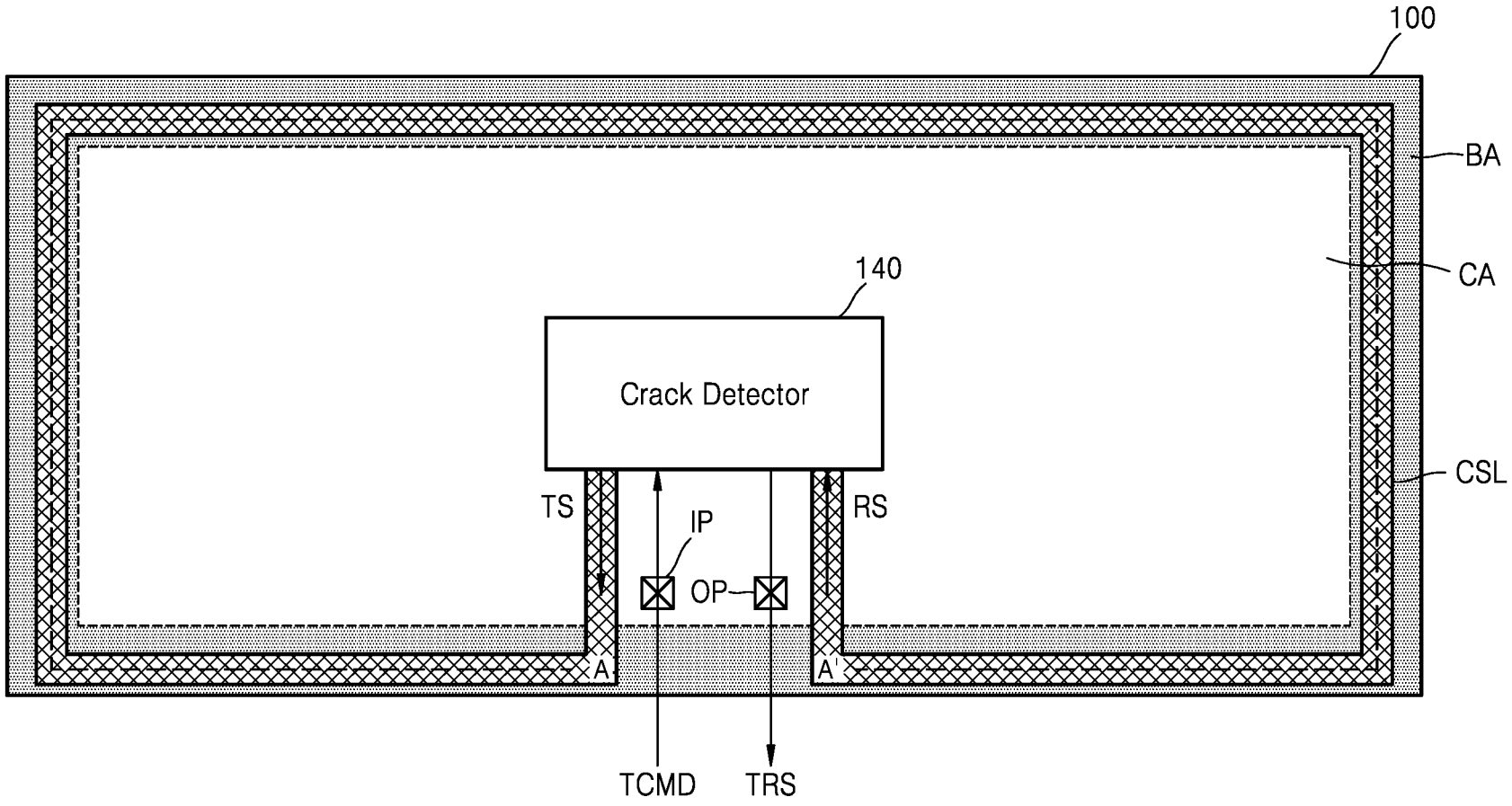
FIG. 2 is a floor plan of a display driving circuit according to an example embodiment of the inventive concept.
Figure 3:
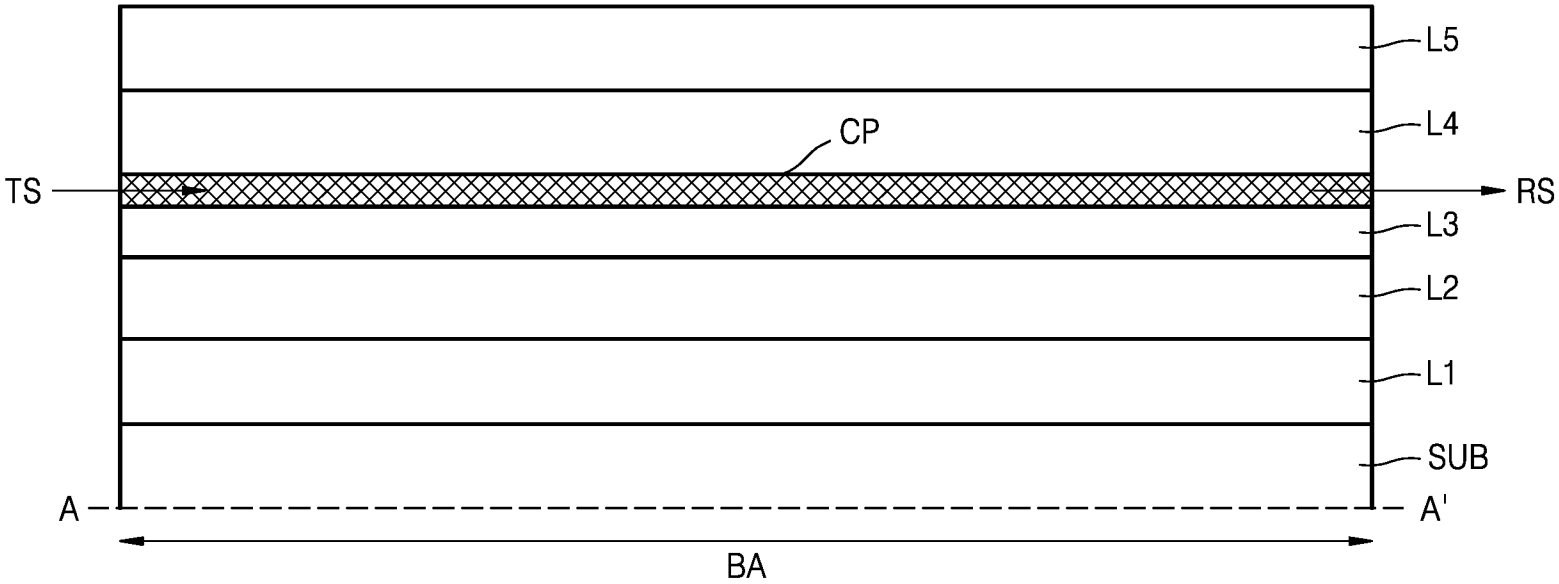
FIGS. 3 and 4 are cross-sectional views of a display driving circuit taken along cross-section A-A' in FIG. 2, according to embodiments.
Figure 4:
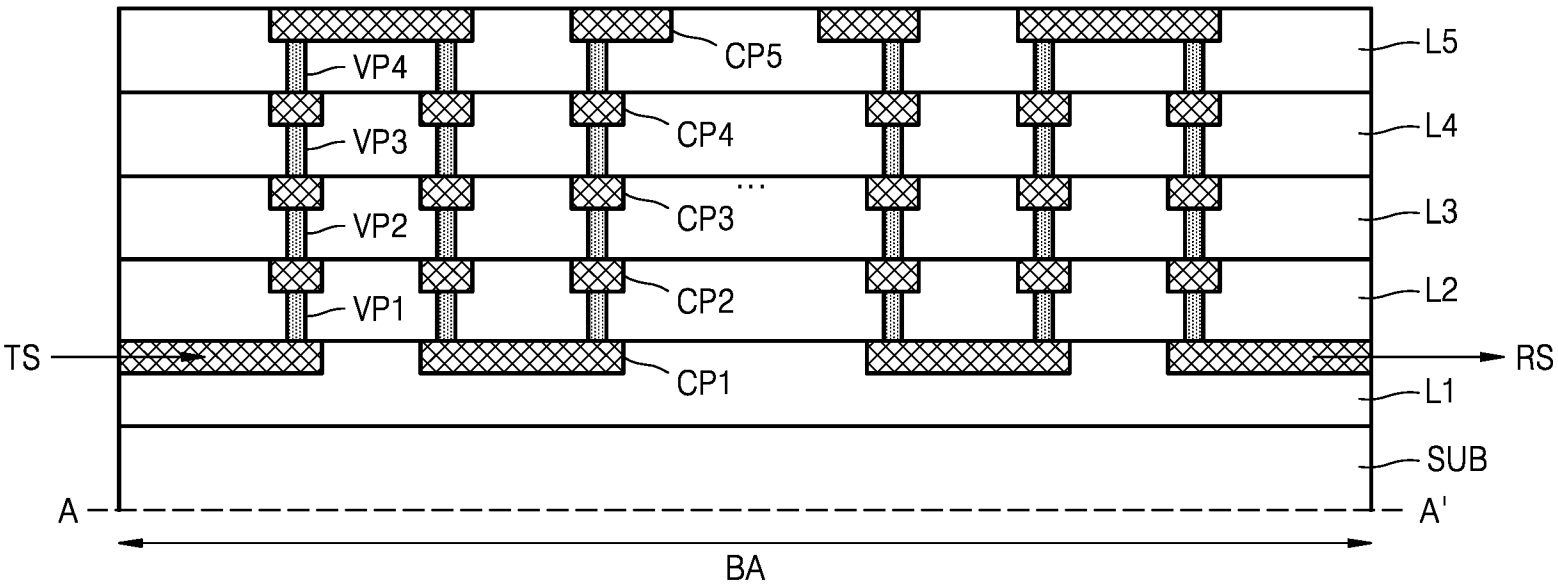

FIG. 2 is a floor plan of the display driving circuit 100 according to an example embodiment of the inventive concept. FIGS. 3 and 4 are cross-sectional views of the display driving circuit 100 taken along cross-section A-A' in FIG. 2, according to embodiments. The display driving circuit 100 of FIG. 2 may be implemented with one display driving chip.

Referring to FIG. 2, the display driving circuit 100 may include a central area CA in which a logic circuit is arranged and a boundary area BA surrounding the central area CA. The crack detector 140 may be in the central area CA.

The display driving circuit 100 may include an input pin IP receiving the test command TCMD and an output pin OP outputting the test result signal TRS. The crack detector 140 may receive the test command TCMD via the input pin IP and output the test result signal TRS via the output pin OP. The crack detector 140 may detect a crack occurring in a crack sensing line CSL in response to the test command TCMD, and output a detection result as the test result signal TRS.

The crack sensing line CSL may be formed in the boundary area BA. The crack sensing line CSL may be electrically connected to the crack detector 140. The crack detector 140 may transmit a test signal TS to one end of the crack sensing line CSL, and may receive a reception signal RS from the other end of the crack sensing line CSL. The crack detector 140 may output the test result signal TRS according to a result of comparing the test signal TS with the reception signal RS.

In an example embodiment, the crack detector 140 may output the test signal TS toggling between a low level and a high level at constant intervals. When no crack has occurred in the crack sensing line CSL, the crack detector 140 may receive the reception signal RS that toggles between a low level and a high level at the same period as the test signal TS. On the other hand, when a crack has occurred in the crack sensing line CSL, the crack detector 140 may receive the reception signal RS maintaining a low level or the reception signal RS maintaining a high level. Accordingly, the crack detector 140 may detect presence or absence of a crack in the crack sensing line CSL from a waveform of the reception signal RS.

Referring to FIGS. 2 and 3, the display driving circuit 100 may include first through fifth layers L1 through L5 sequentially stacked on a substrate SUB. Each layer may be formed of an electrically-insulative material, and may be described as an insulation layer. A conductive pattern CP may be formed in one or more of the first through fifth layers L1 through L5. FIG. 3 illustrates only five layers on the substrate SUB for convenience of description, but the display driving circuit 100 according to the inventive concept is not limited thereto, and the number of layers included in the display driving circuit 100 may be variously configured.

In an example embodiment, such as shown in FIG. 3, the crack sensing line CSL may include a conductive pattern formed in or on only one of the first through fifth layers L1 through L5 in the boundary area BA. For example, the crack sensing line CSL may include the conductive pattern CP at the third layer L3 in the boundary area BA. However, this is only for convenience of description, and the crack sensing line CSL may be formed at a layer other than the third layer L3 among the first through fifth layers L1 through L5. As shown in FIGS. 2 and 3, the conductive pattern CP may be included at only a portion of the third layer L3, such as only in the boundary area for the third layer L3. At the region where the conductive pattern CP is formed, e.g., from a plan view, a topmost surface of the third layer L3 may contact the conductive pattern CP and a bottom surface of the third layer L3 may contact second layer L2. For other regions, where the conductive pattern CP is not formed, a topmost surface of the third layer L3 may contact fourth layer L4 and a bottom surface of the third layer L3 may contact second layer L2.

In an example embodiment, the conductive pattern CP may include metal, conductive metal nitride, metal silicide, or a combination thereof. For example, the conductive pattern CP may include a conductive material such as tungsten (W), molybdenum (Mo), titanium (Ti), cobalt (Co), tantalum (Ta), nickel (Ni), tungsten silicide, titanium silicide, cobalt silicide, tantalum silicide, and nickel silicide.

Referring to FIGS. 2 and 4, in an example embodiment, the crack sensing line CSL may include conductive patterns formed in or on a group of different layers among the first through fifth layers L1 through L5 in the boundary area BA. In this case, the conductive patterns CP constituting the crack sensing line CSL may overlap each other in a direction perpendicular to the substrate SUB.

In an example embodiment, the crack sensing line CSL may include first through fifth conductive patterns CP1 through CP5 formed in or on the first through fifth layers L1 through L5 in the boundary area BA, respectively. For example, the crack sensing line CSL may include the first conductive pattern CP1 at the first layer L1, the second conductive pattern CP2 at the second layer L2, the third conductive pattern CP3 at the third layer L3, the fourth conductive pattern CP4 at the fourth layer L4, and the fifth conductive pattern CP5 at the fifth layer L5. In addition, the crack sensing line CSL may include a first via pattern VP1, a second via pattern VP2, a third via pattern VP3, and a fourth via pattern VP4. The first via pattern VP1 may electrically connect the first conductive pattern CP1 to the second conductive pattern CP2 between the first conductive pattern CP1 and the second conductive pattern CP2 and may be formed in the second layer L2, the second via pattern VP2 may electrically connect the second conductive pattern CP2 to the third conductive pattern CP3 between the second conductive pattern CP2 and the third conductive pattern CP3 and may be formed in the third layer L3, the third via pattern VP3 may electrically connect the third conductive pattern CP3 to the fourth conductive pattern CP4 between the third conductive pattern CP3 and the fourth conductive pattern CP4 and may be formed in the fourth layer L4, and the fourth via pattern VP4 may electrically connect the fourth conductive pattern CP4 to the fifth conductive pattern CP5 between the fourth conductive pattern CP4 and the fifth conductive pattern CP5 and may be formed in the fifth layer L5.

The crack sensing line CSL may include the first through fifth conductive patterns CP1 through CP5 and the first through fourth via patterns VP1 through VP4, which allow the test signal TS to repeatedly pass through the first through fifth conductive patterns CP1 through CP5. A structure of the first through fifth conductive patterns CP1 through CP5 and the first through fourth via patterns VP1 through VP4 in this manner may be described as a net shape. The structure of the first through fifth conductive patterns CP1 through CP5 and the first through fourth via patterns VP1 through VP4 illustrated in FIG. 4 is one example of the crack sensing line CSL having the net shape, but the shape of the crack sensing line CSL is not limited thereto. A shape of the CSL line depicted in FIG. 4 may also be described as a fence shape.

Accordingly, the test signal TS may be transmitted by repeatedly passing through the first conductive pattern CP1, the second conductive pattern CP2, the third conductive pattern CP3, the fourth conductive pattern CP4, and the fifth conductive pattern CP5. The display driving circuit 100 according to the inventive concept may, by including the crack sensing line CSL including the conductive patterns formed on different layers from each other, prevent a situation in which the display driving circuit 100 does not detect a crack because a crack does not occur in the crack sensing line CSL even though a crack occurs in the boundary area BA thereof.

Figure 5:
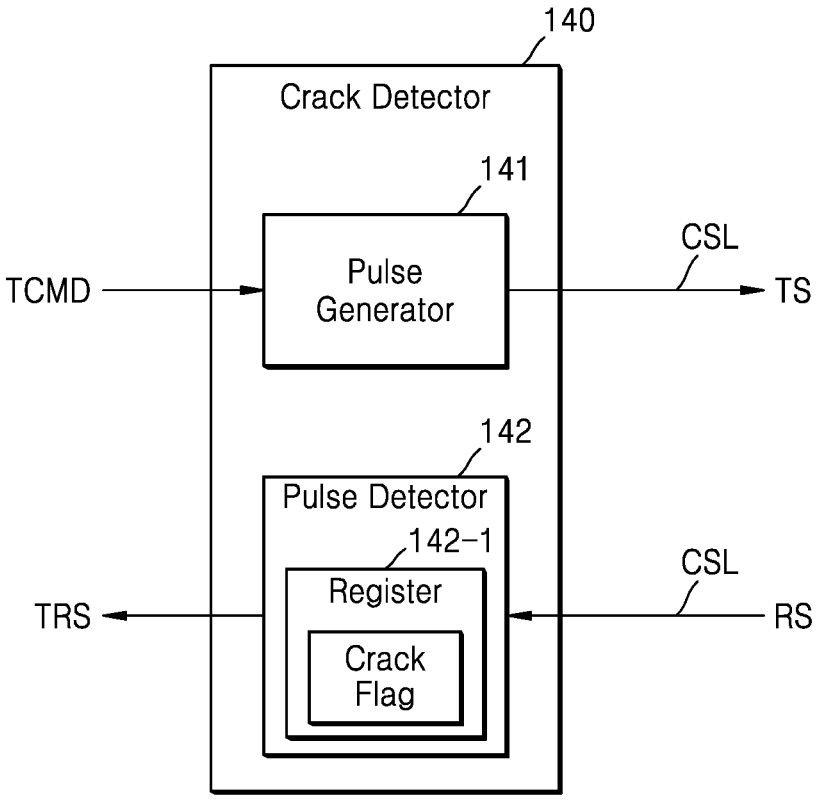
FIG. 5 is a block diagram of a crack detector of a display driving circuit, according to an example embodiment of the inventive concept.

FIG. 5 is a block diagram of the crack detector 140 (e.g., crack detector circuit) of the display driving circuit 100, according to an example embodiment of the inventive concept. The crack detector 140 of FIG. 5 is an embodiment of the crack detector 140 in FIG. 2.

Referring to FIG. 5, the crack detector 140 may include a pulse generator 141 and a pulse detector 142, also described as a pulse generator circuit and pulse detector circuit. In an example embodiment, when the test command TCMD is received, the pulse generator 141 generates the test signal TS in response to the test command TCMD, and transmits the test signal TS to the crack sensing line CSL. However, the pulse generator 141 is not limited thereto, and the pulse generator 141 may be configured to generate the test signal TS to periodically perform a crack test operation even when the test command TCMD is not received. For example, the pulse generator 141 may include hardware (e.g., logic devices and other circuitry) and optionally computer program code programmed to generate a test signal TS in response to receiving a test command TCMD, or to generate and output a test signal TS periodically.

The pulse detector 142 receives the reception signal RS via the crack sensing line CSL, and detects whether a crack has occurred by using a waveform of the reception signal RS. The pulse detector 142 is configured to output the test result signal TRS according to the waveform of the reception signal RS. For example, the pulse detector 142 may include hardware (e.g., logic devices and other circuitry) and optionally computer program code configured (e.g., programmed) to measure a period of the reception signal RS and output the test result signal TRS.

In an example embodiment, the pulse detector 142 includes a register 142-1. When it is determined that no crack has occurred in the crack sensing line CSL, the pulse detector 142 may set a crack flag to a first level (for example, a low level) in the register 142-1. On the other hand, when the pulse detector 142 detects a crack, the crack flag may be set to a second level (for example, a high level) in the register 142-1. The pulse detector 142 may output the test result signal TRS according to the crack flag.

In an example embodiment, the pulse detector 142 may receive the test command TCMD. The pulse detector 142 may output the crack flag set in the register 142-1 as the test result signal TRS in response to the test command TCMD. For example, the pulse detector 142 may be configured either start a test based on the test command TCMD or to self-test for cracks (e.g., periodically), and in either case to store the crack flag, for example in a register 142-1. The test, or periodic self-test may include comparing a test signal TS input to the crack sensing line CSL to a reception signal RS output from the crack sensing line CSL to determine if the waveforms are the same. If the two signals have matching waveforms, the crack flag may be set to a level indicating no cracks. If the waveforms are different, the crack flag may be set to a level indicating cracks. As a result, when a test command TCMD is received, the resulting crack flag level can be output as a test result signal TRS.

Figure 6A:
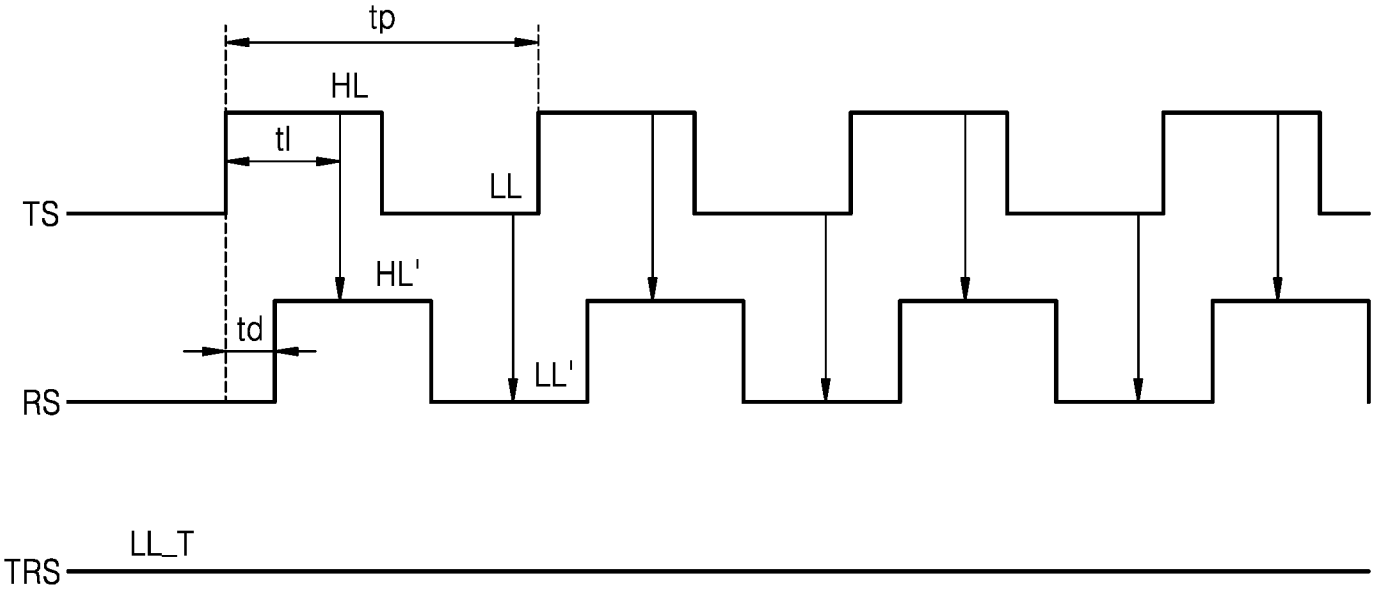
FIG. 6A is a timing diagram illustrating a received signal and a test result signal in a normal state in which no crack has occurred in a display driving circuit, according to an example embodiment of the inventive concept.
Figure 6B:
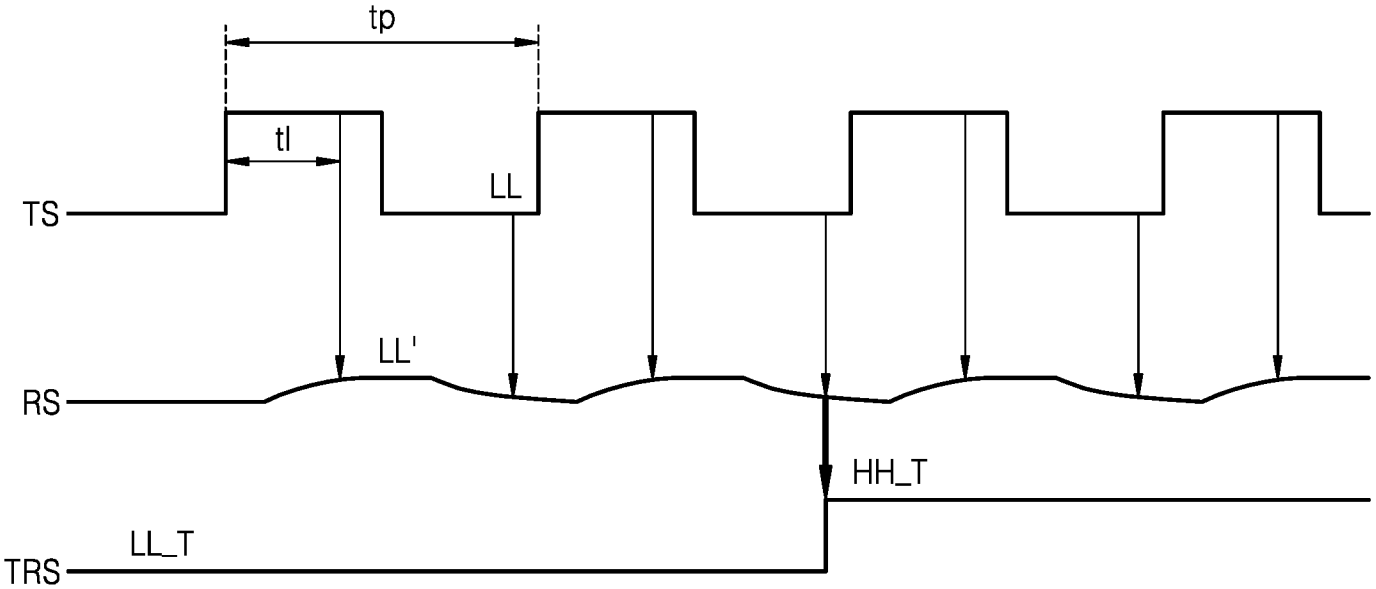
FIG. 6B is a timing diagram illustrating a received signal and a test result signal in a poor state in which a crack has occurred in a display driving circuit, according to an example embodiment of the inventive concept.

FIG. 6A is a timing diagram illustrating the reception signal RS and the test result signal TRS in a normal state in which no crack has occurred in the display driving circuit 100, according to an example embodiment of the inventive concept. FIG. 6B is a timing diagram illustrating the reception signal RS and the test result signal TRS in a poor state in which a crack has occurred in the display driving circuit 100, according to an example embodiment of the inventive concept.

Referring to FIGS. 5 and 6A, the pulse generator 141 may generate the test signal TS having a certain period tp and toggling between a low level LL and a high level HL. The pulse generator 141 may generate the test signal TS to include more than a certain number of pulses. For example, the pulse generator 141 may generate the test signal TS to include at least two pulses. By generating the test signal TS to include more than a certain number of pulses rather than one pulse, an error occurring in a process of determining whether a crack has been generated by using the waveform of the reception signal RS may be reduced.

The test signal TS may be transmitted via the crack sensing line CSL and be received back by the pulse detector 142 as the reception signal RS. In a normal state in which no crack has occurred in the display driving circuit 100, the reception signal RS may be a signal having the same period tp as the test signal TS and toggling between a low level LL' and a high level HL' (e.g., the low level LL' and high level HL' may have an expected value compared to the low level LL and high level HL of the test signal TS). Due to parasitic resistance and parasitic capacitance of the crack sensing line CSL, the reception signal RS may be delayed by a delay time td compared with the test signal TS. An expected delay time td may be known in advance.

The pulse detector 142 may further include a latch circuit (for example, a latch or flip-flop) for latching the reception signal RS, and the pulse detector 142 may determine a time point for latching the reception signal based on the delay time td. For example, after a time point passes by a latch time t1 from a time point at which the test signal TS has transitioned from the low level LL to the high level HL, the reception signal RS may be latched, and after a time point passes by the latch time t1 from a time point at which the test signal TS has transitioned from the high level HL to the low level LL, the reception signal RS may be latched.

The pulse detector 142 may determine whether a result of latching the reception signal RS is the same as the test signal TS in a certain period. When it is determined that the result of latching the received signal RS is the same as the test signal TS, the pulse detector 142 may determine that the display driving circuit 100 is in a normal state without a crack. For example, the pulse detector 142 may measure a period (or two periods) of the reception signal RS and compare the period with the period tp (or two periods) of the test signal TS, and when both periods are the same, may determine a state as the normal state. To do so, in some embodiments, the pulse detector 142 may measure the high level HL' and low level LL' of both the test signal TS and the reception signal RS, and may compare the respective high levels HL' and low levels LL' to determine if they correspond to the expected high level HL' and low level LL' based on the high level HL and low level LL of the test signal TS (e.g., using a logic circuit). In some embodiments, the expected high level HL' and low level LL' are the same as the high level HL and low level LL of the test signal TS. In some embodiments, when the high levels (e.g., HL and HL') of the respective test signal TS and reception signal RS are the same and the low levels (e.g., LL and LL') of the respective test signal TS and reception signal RS are the same, and when the period of the reception signal RS and the period of the test signal TS are the same, the pulse detector 142 may determine a state as the normal state. For example, as mentioned above, when both the test signal TS and the reception signal RS have the same or substantially the same waveform, the pulse detector 142 may determine a state as the normal state. Terms such as "same," or "equal," as used herein encompass identicality or near identicality including variations that may occur, for example, due to manufacturing processes. The term "substantially" may be used herein to emphasize this meaning, unless the context or other statements indicate otherwise.

The pulse detector 142 may set the crack flag of the first level (for example, the low level) in the register 142-1, to indicate the normal state. The pulse detector 142 may output the test result signal TRS of a first level (for example, low level LL_T).

Referring to FIGS. 5 and 6B, when a crack occurs in the display driving circuit 100, the reception signal RS may maintain the low level LL'. For example, the reception signal RS may be substantially flat, or may include a high level significantly different from the expected high level HL'. However, unlike as illustrated in FIG. 6B, in some embodiments, when a crack occurs, the reception signal RS may maintain a high level (e.g., in case a crack causes a short circuit for the reception signal RS at a level different from the expected low level LL').

The pulse detector 142 may determine whether a result of latching the reception signal RS is the same as the test signal TS in a certain period (or in some embodiments, over two periods). For example, the pulse detector 142 may determine that a crack has occurred in the display driving circuit 100 when all of the results of latching the reception signal RS four equally-spaced times, for example, spanning two periods, are different from the test signal TS. When it is determined that a crack has occurred in the display driving circuit 100, the pulse detector 142 may set the crack flag at a second level (for example, a high level) in the register 142-1. The pulse detector 142 may change and output the test result signal TRS from a first level LL_T to a second level (for example, a high level HL_T), as the crack flag is changed.

Figure 7:
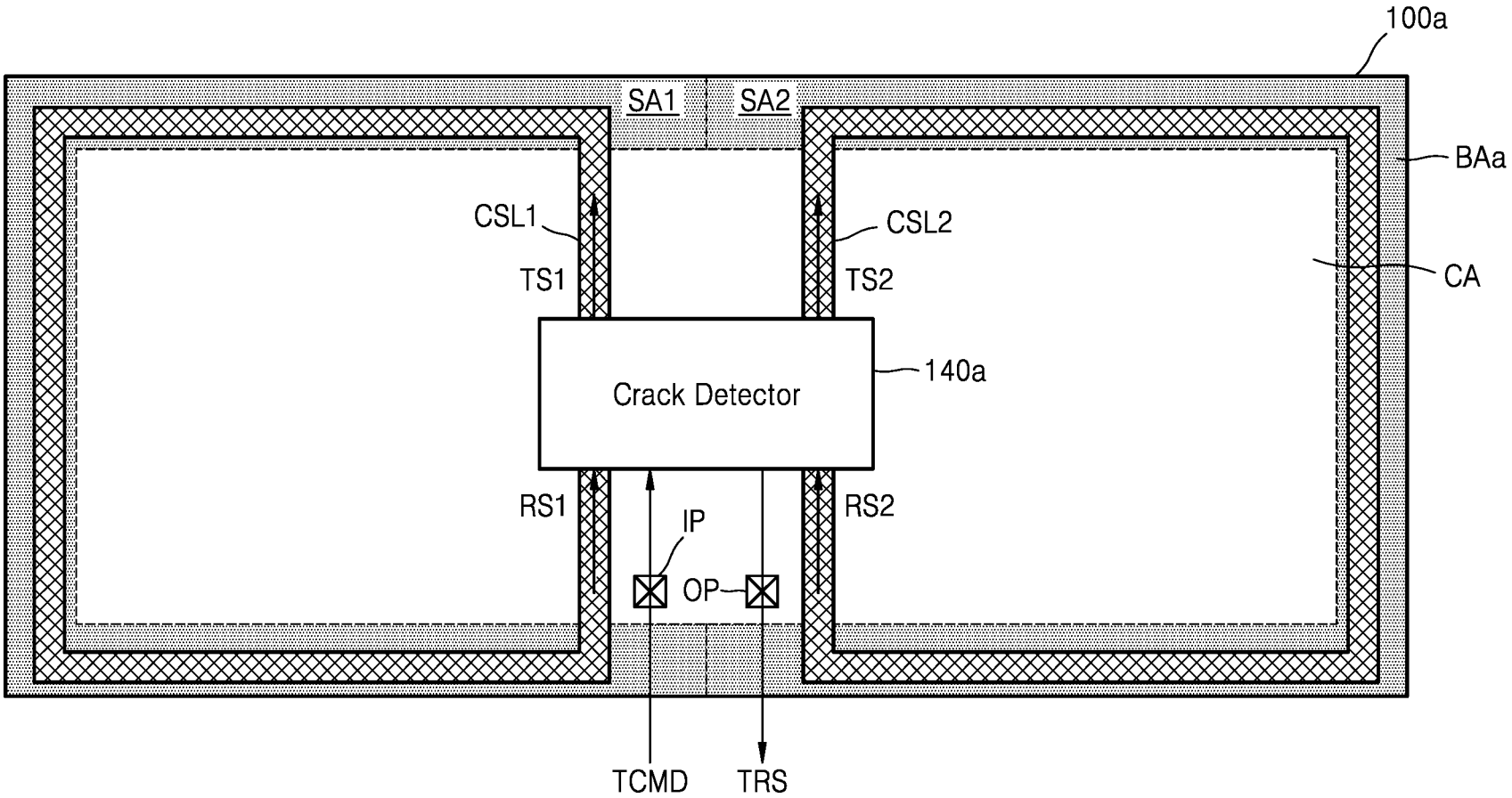
FIG. 7 is a floor plan of a display driving circuit according to an example embodiment of the inventive concept.

FIG. 7 is a floor plan of a display driving circuit 100*a* according to an example embodiment of the inventive concept. The display driving circuit 100*a* of FIG. 7 may be implemented with one display driving chip. In the description with reference to FIG. 7, duplicate description of the same reference numerals as in FIG. 2 are omitted.

Referring to FIG. 7, the display driving circuit 100*a* may include the central area CA in which a logic circuit is arranged and a boundary area BAa surrounding the central area CA. A crack detector 140*a* may be in the central area CA.

The boundary area BAa may include a first sub-area SA1 and a second sub-area SA2. A first crack sensing line CSL1 may be in the first sub-area SA1, and a second crack sensing line CSL2 may be in the second sub-area SA2. The first crack sensing line CSL1 and the second crack sensing line CSL2 may be electrically separated from each other.

Each of the first crack sensing line CSL1 and the second crack sensing line CSL2 may be electrically connected to the crack detector 140*a*. The crack detector 140*a* may transmit a first test signal TS1 to one end of the first crack sensing line CSL1, and receive a first reception signal RS1 from the other end of the first crack sensing line CSL1. The crack detector 140*a* may transmit a second test signal TS2 to one end of the second crack sensing line CSL2, and receive a second reception signal RS2 from the other end of the second crack sensing line CSL2.

In an example embodiment, the crack detector 140*a* may output the first and second test signals TS1 and TS2 toggling between a low level and a high level at constant intervals. When no crack has occurred in the first crack sensing line CSL, the crack detector 140*a* may receive the first reception signal RS1 that toggles between a low level and a high level at the same period as the first test signal TS1. For example, the waveform of the first test signal TS1 may match the waveform of the first reception signal RS1. When no crack has occurred in the second crack sensing line CSL2, the crack detector 140*a* may receive the second reception signal RS2 that toggles between a low level and a high level at the same period as the second test signal TS2. For example, the waveform of the second test signal TS2 may match the waveform of the second reception signal RS2.

However, when a crack occurs in the first crack sensing line CSL1, the crack detector 140*a* may receive the first reception signal RS1, for example maintaining a constant level, or otherwise not matching the first test signal TS1. In addition, when a crack occurs in the second crack sensing line CSL2, the crack detector 140*a* may receive the second reception signal RS2, for example maintaining a constant level, or otherwise not matching the first test signal TS1. Accordingly, the crack detector 140*a* may detect whether a crack is formed in the first crack sensing line CSL1 by using a waveform of the first reception signal RS1, and sense whether a crack is formed in the second crack sensing line CSL2 from a waveform of the second reception signal RS2.

In an example embodiment, the first crack sensing line CSL1 and the second crack sensing line CLS2 may be symmetrically arranged with respect to each other from the crack detector 140*a* (e.g., crack detector circuit). For example, on the floor plan of the display driving circuit 100*a*, the first crack sensing line CSL1 may be on the left side of the crack detector 140*a*, and the second crack sensing line CLS2 may be on the right side of the crack detector 140*a*. Accordingly, the crack detector 140*a* may obtain the location information about the crack occurrence via the first reception signal RS1 and the second reception signal RS2.

The display driving circuit 100*a* according to the inventive concept may include sub-areas, for example, the boundary area BAa that is subdivided into the first sub-area SA1 and the second sub-area SA2, and because different crack sensing lines from each other are formed in the first sub-area SA1 and the second sub-area SA2, the location information about the crack occurrence in the display driving circuit 100*a* may be obtained. For example, the display driving circuit 100*a* may obtain the location information about the crack occurrence by detecting a crack sensing line in which a crack has occurred among the first crack sensing line CSL1 and the second crack sensing line CSL2.

In an example embodiment, the first crack sensing line CSL1 and the second crack sensing line CSL2 may include a conductive pattern formed on one layer of a plurality of layers formed on the substrate SUB. For example, the description of the crack sensing line CSL illustrated in FIG. 3 may be applied to each of the first crack sensing line CSL1 and the second crack sensing line CSL2.

Alternatively, in an example embodiment, the first crack sensing line CSL1 and the second crack sensing line CSL2 may include conductive patterns formed on different layers among the plurality of layers formed on the substrate SUB. For example, the first crack sensing line CSL1 and the second crack sensing line CSL2 may include conductive patterns on each layer of the plurality of layers formed on the substrate SUB. For example, the description of the crack sensing line CSL illustrated in FIG. 4 may be applied to each of the first crack sensing line CSL1 and the second crack sensing line CSL2.

Figure 8:
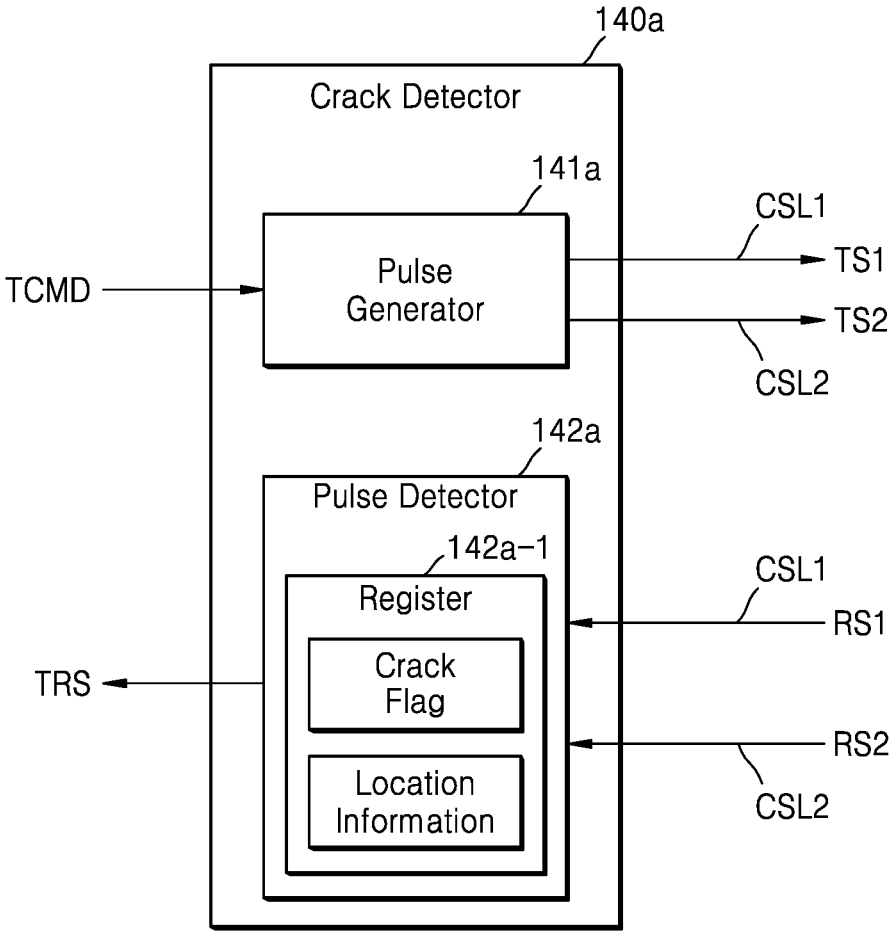
FIG. 8 is a block diagram of a crack detector of a display driving circuit, according to an example embodiment of the inventive concept.

FIG. 8 is a block diagram of the crack detector 140*a* of the display driving circuit, according to an example embodiment of the inventive concept. The crack detector 140*a* of FIG. 8 is an embodiment of the crack detector 140*a* of FIG. 7. In the description with reference to FIG. 8, duplicate description of the same reference numerals as in FIG. 5 are omitted.

Referring to FIG. 8, the crack detector 140*a* may include a pulse generator 141*a* and a pulse detector 142*a*. In an example embodiment, when the test command TCMD is received, the pulse generator 141*a* may generate the first test signal TS1 and the second test signal TS2 in response to the test command TCMD. However, even when the test command TCMD is not received, the pulse generator 141*a* may generate the test signal TS to periodically perform a crack test operation, as discussed above.

The pulse generator 141*a* may transmit the first test signal TS1 to the first crack sensing line CSL1 and transmit the second test signal TS2 to the second crack sensing line CSL2. In this case, the first test signal TS1 and the second test signal TS2 may toggle between a high level and a low level with a certain period. In an example embodiment, the period of each of the first test signal TS1 and the second test signal TS2 may be the same.

In an example embodiment, the pulse generator 141*a* may simultaneously output the first test signal TS1 and the second test signal TS2. Alternatively, in an example embodiment, the pulse generator 141*a* may output the second test signal TS2 after the first test signal TS1. Therefore, the crack detector 140*a* may simultaneously detect cracks occurred in each of the first crack sensing line CSL1 and the second crack sensing line CSL2, or after detecting a crack that occurred in the first crack sensing line CSL1, may sequentially detect a crack that occurred in the second crack sensing line CSL2.

The pulse detector 142*a* may receive the first reception signal RS1 via the first crack sensing line CSL1, and may receive the second reception signal RS2 via the second crack sensing line CSL2. The pulse detector 142*a* may detect a crack that occurred in the first crack sensing line CSL1 by using the waveform of the first reception signal RS1, and may detect a crack that occurred in the second crack sensing line CSL2 by using the waveform of the second reception signal RS2.

In an example embodiment, the pulse detector 142*a* may include a register 142*a*-1. When it is determined that a crack has not occurred in the first crack sensing line CSL1 and the second crack sensing line CSL2, that is, when the display driving circuit is determined to be in a normal state, the pulse detector 142*a* may set the crack flag at the first level (for example, the low level) in the register 142*a*-1. On the other hand, when it is determined that a crack has occurred in at least one of the first crack sensing line CSL1 and the second crack sensing line CSL2, the pulse detector 142*a* may set the crack flag at the second level (for example, the high level) in the register 142*a*-1. The pulse detector 142*a* may output the test result signal TRS according to the crack flag.

In an example embodiment, the location information, which is information about the location where the crack has occurred, may be further stored in the register 142*a*-1. However, unlike as illustrated in FIG. 8, the location information may be further stored in a memory other than the register 142*a*-1.

For example, when it is determined that a crack has occurred in the first crack sensing line CSL1, the pulse detector 142*a* may store the location information corresponding to the first crack sensing line CSL1 in the register 142*a*-1. In addition, when it is determined that a crack has occurred in the second crack sensing line CSL2, the pulse detector 142*a* may store the location information corresponding to the second crack sensing line CSL2 in the register 142*a*-1.

In an example embodiment, the pulse detector 142*a* may receive the test command TCMD. The pulse detector 142*a* may output the crack flag set in the register 142-1 as the test result signal TRS in response to the test command TCMD.

Figure 9:
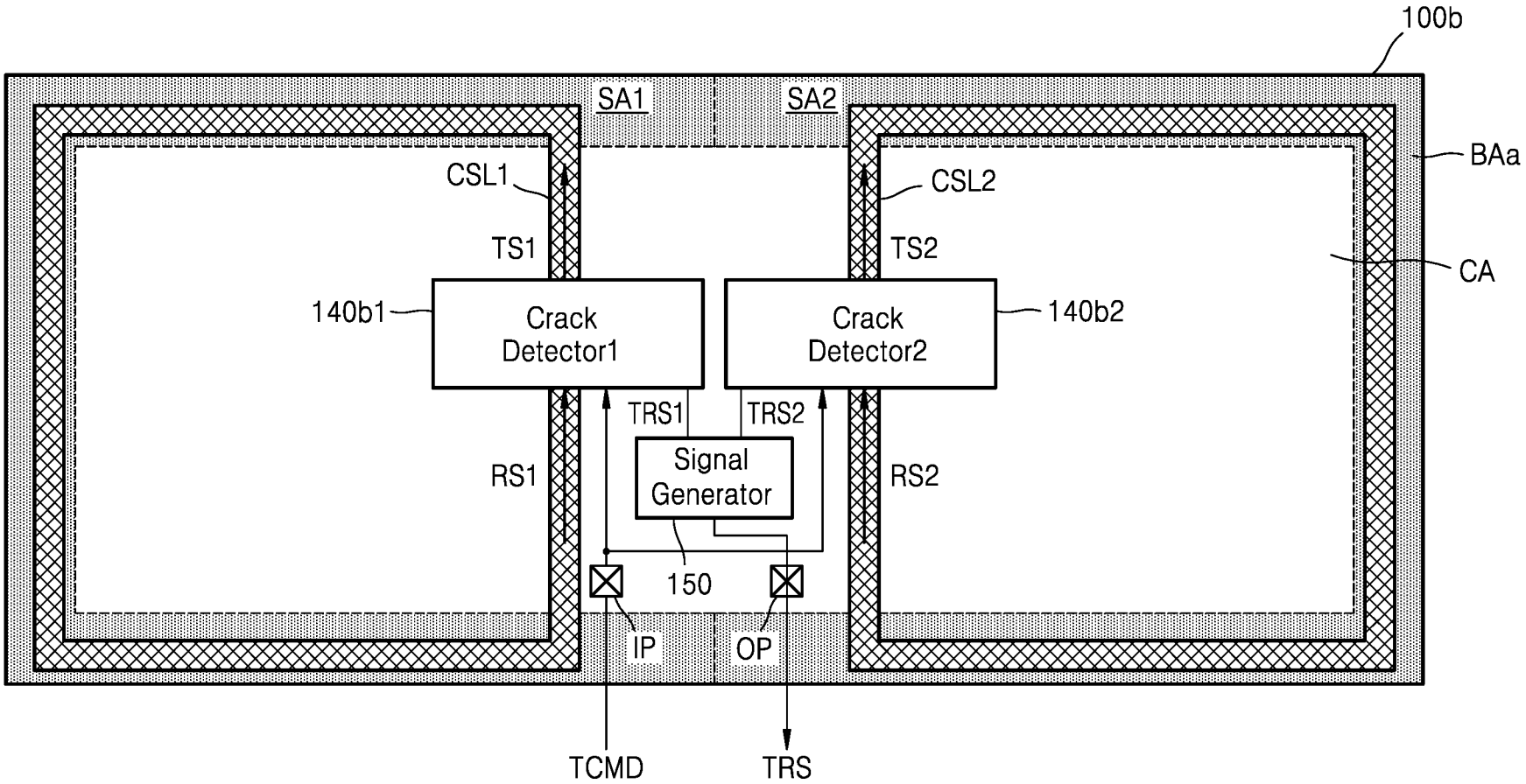
FIG. 9 is a floor plan of a display driving circuit, according to an example embodiment of the inventive concept.

FIG. 9 is a floor plan of a display driving circuit 100*b* according to an example embodiment of the inventive concept. The display driving circuit 100*b* of FIG. 9 may be implemented with one display driving chip. In the description with reference to FIG. 9, duplicate description of the same reference numerals as in FIGS. 2 and 7 are omitted.

Referring to FIG. 9, the display driving circuit 100*b* may include a central area CA in which a logic circuit is arranged and a boundary area BAa surrounding the central area CA. The display driving circuit 100*b* may include a first crack detector 140*b*1 (e.g., second crack detector circuit) and a second crack detector 140*b*2 (e.g., first crack detector circuit), and the first crack detector 140*b*1 and the second crack detector 140*b*2 may be in the central area CA. The first crack detector 140*b*1 may output the first test result signal TRS1 in response to the test command TCMD, and the second crack detector 140*b*2 may output the second test result signal TRS2 in response to the test command TCMD.

In an example embodiment, each of the first crack detector 140*b*1 and the second crack detector 140*b*2 may include a pulse generator and a pulse detector. For example, the configuration of each of the first crack detector 140*b*1 and the second crack detector 140*b*2 may be applied according to the crack detector 140 of FIG. 5.

The first crack detector 140*b*1 may transmit the first test signal TS1 to one end of the first crack sensing line CSL1, and receive the first reception signal RS1 from the other end of the first crack sensing line CSL1. The second crack detector 140*b*2 may transmit the second test signal TS2 to one end of the second crack sensing line CSL2, and receive the second reception signal RS2 from the other end of the second crack sensing line CSL2.

In an example embodiment, the first crack detector 140*b*1 may output the first test signal TS1 toggling between a low level and a high level at constant intervals. In an example embodiment, the second crack detector 140*b*2 may output the second test signal TS toggling between a low level and a high level at constant intervals.

When no crack has occurred in the first crack sensing line CSL, the first crack detector 140*b*1 may receive the first reception signal RS1 that toggles between a low level and a high level at the same period as the first test signal TS1. When no crack has occurred in the second crack sensing line CSL2, the second crack detector 140*b*2 may receive the second reception signal RS2 that toggles between a low level and a high level at the same period as the second test signal TS2. However, when a crack has occurred in the first crack sensing line CSL1, the first crack detector 140*b*1 may receive the first reception signal RS1, for example maintaining a constant level. In addition, when a crack has occurred in the second crack sensing line CSL2, the second crack detector 140*b*2 may receive the second reception signal RS2, for example maintaining a constant level. Accordingly, the first crack detector 140*b*1 may detect whether a crack is formed in the first crack sensing line CSL1 by using a waveform of the first reception signal RS1, and the second crack detector 140*b*2 may sense whether a crack is formed in the second crack sensing line CSL2 from a waveform of the second reception signal RS2.

For example, when no crack is detected in the first crack sensing line CSL1, the first crack detector 140*b*1 may output the first test result signal TRS1 of the first level, and when a crack is detected in the first crack sensing line CSL1, the first crack detector 140*b*1 may output the first test result signal TRS1 of the second level. When no crack is detected in the second crack sensing line CSL2, the second crack detector 140*b*2 may output the second test result signal TRS2 of the first level, and when a crack is detected in the second crack sensing line CSL2, the second crack detector 140*b*2 may output the second test result signal TRS2 of the second level.

In an example embodiment, the display driving circuit 100*b* may further include a signal generator 150 that receives the first test result signal TRS1 and the second test result signal TRS2 and generates the test result signal TRS. The signal generator 150 may output the test result signal TRS via the output pin OP.

In an example embodiment, when both of the first test result signal TRS1 and the second test result signal TRS2 are of the first level, the signal generator 150 outputs the test result signal TRS of the first level. In addition, when at least one of the first test result signal TRS1 and the second test result signal TRS2 is of the second level, the signal generator 150 outputs the test result signal TRS of the second level. Accordingly, the test result signal TRS may indicate whether a crack is formed inside the display driving circuit 100*b*.

Alternatively, in an example embodiment, the signal generator 150 may generate the test result signal TRS to further include the location information about the crack occurrence in the first crack sensing line CSL1 and the second crack sensing line CSL2.

Figure 10:
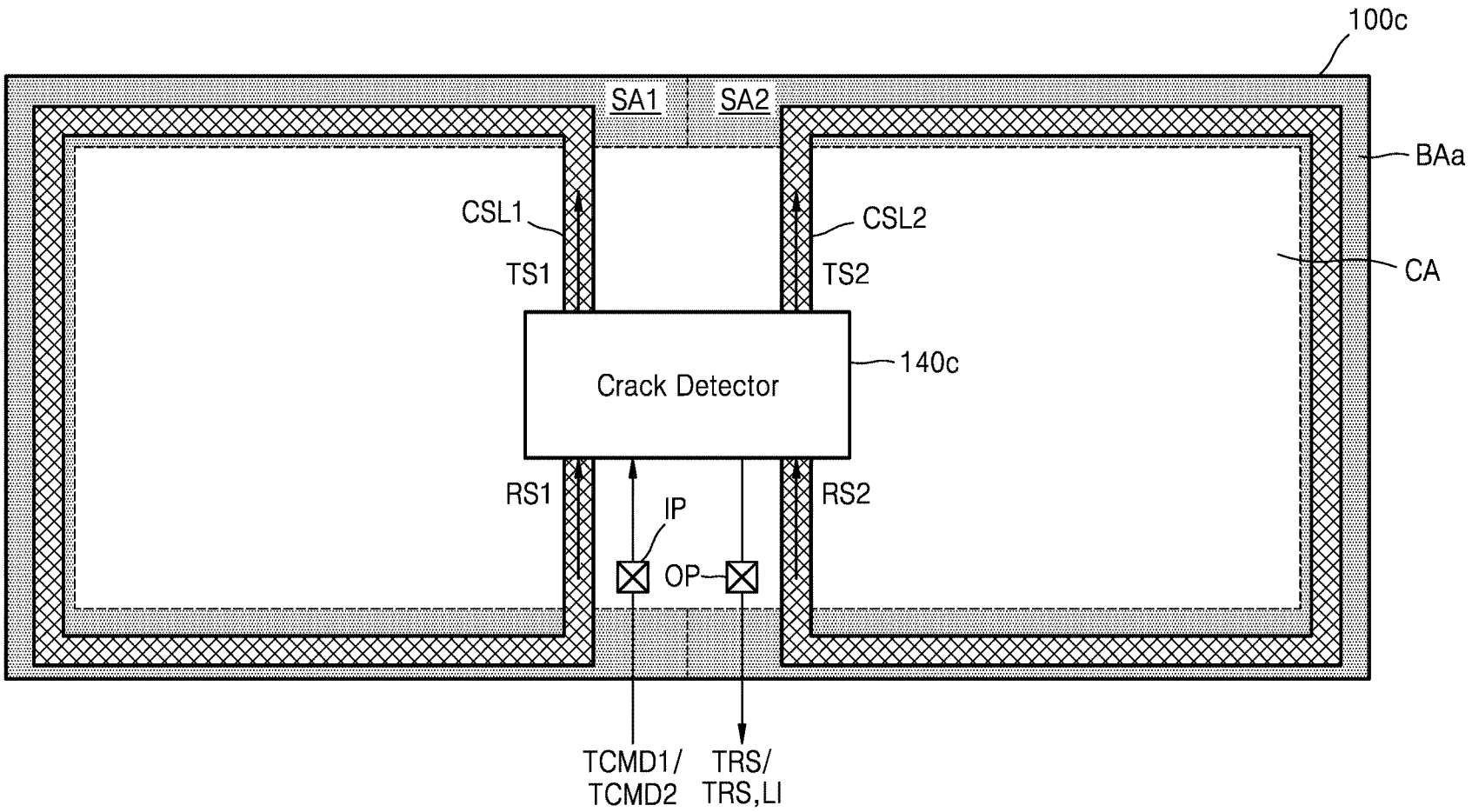
FIG. 10 is a floor plan of a display driving circuit according to an example embodiment of the inventive concept.

FIG. 10 is a floor plan of a display driving circuit 100*c* according to an example embodiment of the inventive concept. The display driving circuit 100*c* of FIG. 10 may be implemented with one display driving chip. In the description with reference to FIG. 10, duplicate description of the same reference numerals as in FIGS. 2 and 7 are omitted.

Referring to FIG. 10, the display driving circuit 100*c* may include the input pin IP receiving a first test command TCMD1 and a second test command TCMD2, and include the output pin OP outputting the test result signal TRS and a location information signal LI. The crack detector 140*c* may receive the first test command TCMD1 and the second test command TCMD2 via the input pin IP, and may output the test result signal TRS and the location information signal LI via the output pin OP. However, unlike as illustrated in FIG. 10, the display driving circuit 100*c* according to an embodiment of the present disclosure may include a first input pin, a second input pin, a first output pin, and a second output pin, and the crack detector 140*c* may receive the first test command TCMD1 and the second test command TCMD2 via different input pins, that is, the first input pin and the second input pin, respectively. In addition, the crack detector 140*c* may output the test result signal TRS and the location information signal LI via different output pins, that is, the first output pin and the second output pin, respectively.

The crack detector 140*c* may output the test result signal TRS in response to the first test command TCMD1. In this case, the test result signal TRS may include information about whether a crack is present in the display driving circuit 100*c*. For example, when the test result signal TRS is at the first level (for example, the low level), the state of the display driving circuit 100*c* may mean a normal state in which no crack has occurred therein, and when the test result signal TRS is at the second level (for example, the high level), the state of the display driving circuit 100*c* may mean a poor state in which a crack has occurred therein.

The crack detector 140*c* may output the test result signal TRS and the location information signal LI in response to the second test command TCMD2. In this case, the location information signal LI may include the location information about the crack occurrence in the display driving circuit 100*c*. For example, the location information signal LI may include location information corresponding to a crack sensing line in which a crack has occurred among the first crack sensing line CSL1 and the second crack sensing line CSL2.

The display driving circuit 100*c* according to the present disclosure may provide to the outside only information about whether a crack has occurred in the display driving circuit 100*c* or may further provide the location information about the crack occurrence, according to the type of a command received from the outside. Accordingly, the display driving circuit 100*c* may selectively provide information about the state of the display driving circuit 100*c* in response to a command.

Figure 11:
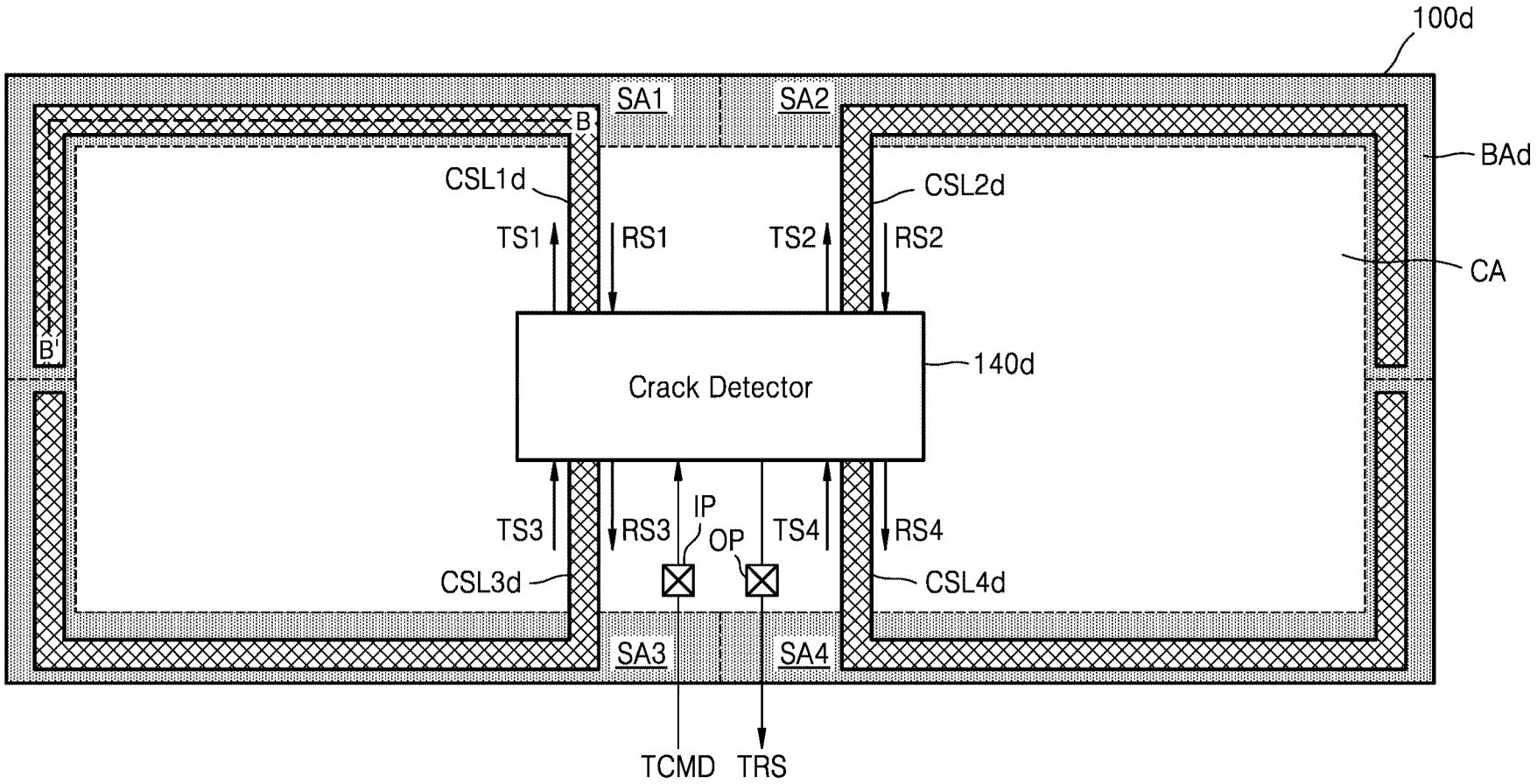
FIG. 11 is a floor plan of a display driving circuit according to an example embodiment of the inventive concept.
Figure 12:
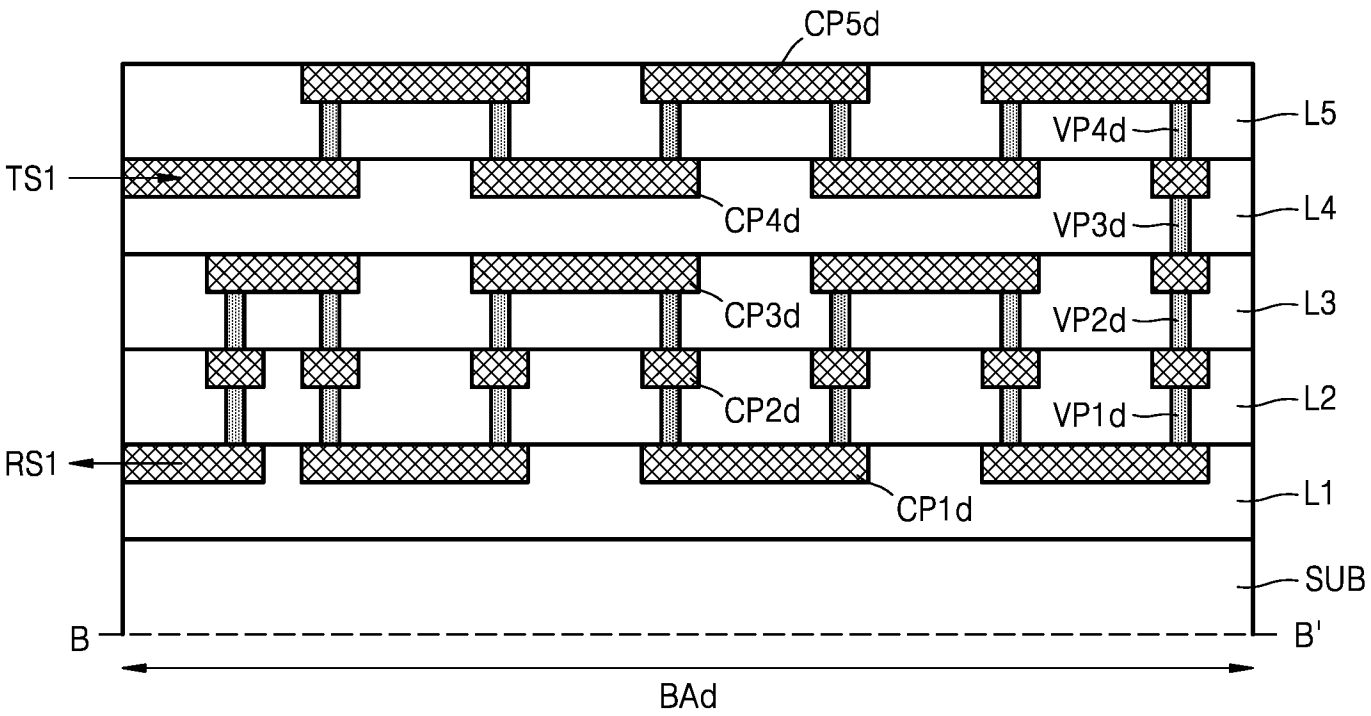
FIG. 12 is a floor plan of a display driving circuit taken along cross-section B-B' in FIG. 11, according to an embodiment.

FIG. 11 is a floor plan of a display driving circuit 100*d* according to an example embodiment of the inventive concept. FIG. 12 is a floor plan of the display driving circuit 100*d* taken along cross-section B-B' in FIG. 11, according to an embodiment. The display driving circuit 100*d* of FIG. 11 may be implemented with one display driving chip. In the description with reference to FIG. 11, duplicate description of the same reference numerals as in FIGS. 2 and 7 are omitted.

Referring to FIG. 11, the display driving circuit 100*d* may include the central area CA in which a logic circuit is arranged and a boundary area BAd surrounding the central area CA. A crack detector 140*d* may be in the central area CA.

First through fourth crack sensing lines CSL1*d* through CSL4*d* may be in the boundary area BAd. The boundary area BAd may include first through fourth sub-areas SA1 through SA4, the first crack sensing line CSL1*d* may be in the first sub-area SA1, the second crack sensing line CSL2*d* may be in the second sub-area SA2, the third crack sensing line CSL3*d* may be in the third sub-area SA3, and the fourth crack sensing line CSL4*d* may be in the fourth sub-area SA4. The first through fourth crack sensing lines CSL1*d* through CSL4*d* may be electrically apart from each other.

Each of the first through fourth crack sensing lines CSL1*d* through CSL4*d* may be electrically connected to the crack detector 140*d*. The crack detector 140*d* may transmit a first test signal TS1 to one end of the first crack sensing line CSL1*d*, and receive a first reception signal RS1 from the other end of the first crack sensing line CSL1*d*. The crack detector 140*d* may transmit a second test signal TS2 to one end of the second crack sensing line CSL2*d*, and receive a second reception signal RS2 from the other end of the second crack sensing line CSL2*d*. The crack detector 140*d* may transmit a third test signal TS3 to one end of the third crack sensing line CSL3*d*, and receive a third reception signal RS3 from the other end of the third crack sensing line CSL3*d*. The crack detector 140*d* may transmit a fourth test signal TS4 to one end of the fourth crack sensing line CSL4*d*, and receive a fourth reception signal RS4 from the other end of the fourth crack sensing line CSL4*d*.

In an example embodiment, the crack detector 140*d* may output the first through fourth test signals TS1 through TS4 toggling between a low level and a high level at constant intervals. When no crack has occurred in the first through fourth crack sensing lines CSL1*d* through CSL4*d*, the crack detector 140*d* may receive the first through fourth reception signals RS1 through RS4 that toggle between a low level and a high level at constant intervals corresponding to the first through fourth test signals TS1 through TS4, respectively. On the other hand, when a crack has occurred in a certain crack sensing line among the first through fourth crack sensing lines CSL1*d* through CSL4*d*, the crack detector 140*d* may receive a reception signal maintaining a constant via the crack sensing line in which a crack has occurred. Accordingly, the crack detector 140*d* may detect whether a crack has occurred in the first through fourth crack sensing lines CSL1*d* through CSL4*d* by using the waveforms of the first through fourth reception signals RS1 through RS4.

In an example embodiment, each of the first through fourth crack sensing lines CSL1*d* through CSL4*d* may be symmetrically arranged in relation to each other with respect to the crack detector 140*d*. For example, assuming that a long side is an X axis and a short side is a Y axis on the floor plan of the display driving circuit 100*d*, the first crack sensing line CSL1*d* may be in the second quadrant of the crack detector 140*d*, the second crack sensing line CLS2*d* may be in the first quadrant of the crack detector 140*d*, the third crack sensing line CSL3*d* may be in the third quadrant of the crack detector 140*d*, and the fourth crack sensing line CLS4*d* may be in the fourth quadrant of the crack detector 140*d*. Accordingly, the crack detector 140*d* may obtain the location information about the crack occurrence via the first through fourth reception signals RS1 through RS4.

The display driving circuit 100*d* according to the inventive concept may include sub-areas, that is, the first through fourth sub-areas SA1 and SA4, into which a boundary area BAd is sub-divided, and because different crack sensing lines from each other are formed in the first through fourth sub-areas SA1 and SA4, the location information about the crack occurrence in the display driving circuit 100*d* may be obtained. For example, the display driving circuit 100*d* may obtain the location information about the crack occurrence by detecting a crack sensing line in which a crack has occurred among the first through fourth crack sensing lines CSL1 and CSL4. The location information about the crack occurrence may be stored in the crack detector 140*d*.

In FIG. 11, the boundary region BAd is illustrated as being subdivided into four sub-areas and in which the first through fourth crack sensing lines CSL1*d* through CSL4*d* are formed, but the display driving circuit 100*d* according to the present disclosure is not limited thereto. The boundary area BAd may be subdivided into various numbers of sub-areas, each sub-area may include a corresponding crack sensing line, and accordingly, the display driving circuit 100*d* may obtain the location information about the crack occurrence.

In FIG. 11, one crack detector 140*d* is illustrated, but the crack detector 140*d* may include first through fourth crack detectors, and the first through fourth crack detectors may be connected to crack sensing lines corresponding to the first through fourth crack sensing lines CSL1*d* through CSL4*d*, respectively. The first through fourth crack detectors may output test signals corresponding to the first through fourth test signals TS1 through TS4, respectively.

Referring to FIGS. 11 and 12, in an example embodiment, the first crack sensing line CSL1 may include conductive patterns formed on or in different layers from each other among the first through fifth layers L1 through L5 in the boundary area BAd. In this case, the conductive patterns constituting the first crack sensing line CSL1*d* may overlap each other in a direction perpendicular to the substrate SUB. In an example embodiment, the first crack sensing line CSL1*d* may include first through fifth conductive patterns CP1*d* through CP5*d* respectively formed t the first through fifth layers L1 through L5 in the boundary area BAd, and may include first through fourth via patterns VP through VP4*d*.

One end of the first crack sensing line CSL1*d* to which the first test signal TS1 is input from the crack detector 140*d* and the other end of the first crack sensing line CSL1*d* to which the first reception signal RS1 is output to the crack detector 140*d* may overlap each other in a direction perpendicular to the substrate SUB. For example, one end of the first crack sensing line CSL1*d* may be on the fourth conductive pattern CP4*d* formed at the fourth layer L4, and the other end of the first crack sensing line CSL1*d* may be on the first conductive pattern CP1*d* formed at the first layer L1. Accordingly, an area occupied by the first crack sensing line CSL1*d* in a cross-section parallel with the substrate SUB may be reduced.

The first test signal TS1 may be transmitted by passing through the first conductive pattern CP1*d*, the second conductive pattern CP2*d*, the third conductive pattern CP3*d*, the fourth conductive pattern CP4*d*, and the fifth conductive pattern CP5*d*. A structure of the first through fifth conductive patterns CP1*d* through CP5*d* and the first through fourth via patterns VP1*d* through VP4*d* in this manner may be defined as a net shape, or fence shape. The structure of the first through fifth conductive patterns CP1*d* through CP5*d* and the first through fourth via patterns VP1*d* through VP4*d* illustrated in FIG. 12 is one example of the first crack sensing line CSL1*d* having the net shape, but the shape of the first crack sensing line CSL1*d* is not limited thereto. The display driving circuit 100*d* according to the inventive concept may, by including the first crack sensing line CSL1*d* including the conductive patterns formed on different layers from each other, prevent a situation in which the crack detector 140*d* does not detect a crack because a crack does not occur in the first crack sensing line CSL1*d* even though a crack occurs in the first sub-area SA1.

In the description with reference to FIG. 12, the first crack sensing line CSL1*d* has been described, and the description of the first crack sensing line CSL1*d* in FIG. 12 may be applied to descriptions of the second through fourth crack sensing lines CSL2*d* through CSL4*d* in FIG. 11.

Figure 13:
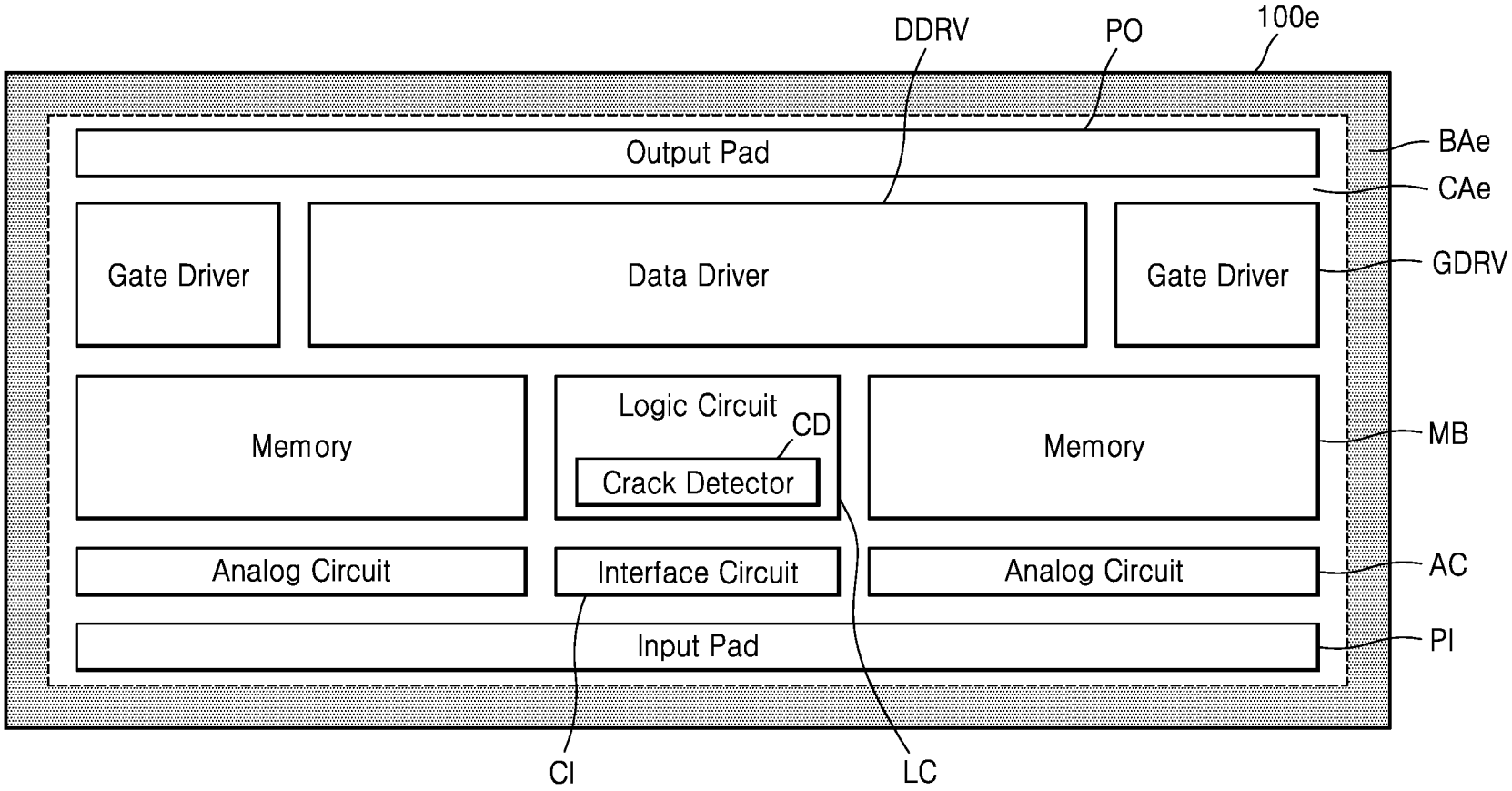
FIG. 13 is a floor plan of a display driving circuit according to an example embodiment of the inventive concept.

FIG. 13 is a floor plan of a display driving circuit 100*e* according to an example embodiment of the inventive concept. The display driving circuit 100*e* of FIG. 13 may be implemented with one display driving chip. The below description uses "top" "bottom," "vertical" and "horizontal" in connection with the drawing orientation. These do not refer, in this explanation, to a direction perpendicular to the substrate.

Referring to FIG. 13, the display driving circuit 100*e* may have a structure in which a vertical length, (e.g., a height) is short and a horizontal length, that is, a width is long. An input pad PI and an output pad PO may be on the bottom and the top of the floor plan, respectively. An interface circuit CI may be at the center of an inner bottom of the floor plan, and an analog circuit AC may be on both sides of the interface circuit CI. A memory MB and the logic circuit LC may be in the central portion. A Data Driver DDRV may be on an upper side of an inner portion, and a gate driver GDRV may be on opposite sides of the data driver DDRV. However, an arrangement of the input pad PI, the output pad PO, the interface circuit CI, the analog circuit AC, the memory MB, the logic circuit LC, the data driver DDRV, and the gate driver GDRV illustrated in FIG. 13 is only an example for convenience of description, and is not limited thereto. For example, the gate driver GDRV may not be included in the display driving circuit 100*e*, and may be an external component of the display driving circuit 100*e*.

The input pad PI, the output pad PO, the interface circuit CI, the analog circuit AC, the memory MB, the logic circuit LC, the data driver DDRV, and the gate driver GDRV may be in a central area CAe of the display driving circuit 100*e*. A crack sensing line may be in a boundary area BAe of the display driving circuit 100*e*. When the display driving circuit 100*e* and the display panel 200 are manufactured in a module, cracks may occur in the boundary area BAe of the display driving circuit 100*e*, and due to the cracks, defects may occur in internal components formed in the central area CAe of the display driving circuit 100*e*. Accordingly, a crack sensing line may be in the boundary area BAe surrounding the central area CAe, and the display driving circuit 100*e* may detect a crack.

The interface circuit CI may receive image signals and input signals from the outside of the display driving circuit 100*e*. In addition, the interface circuit CI may transmit the received image signals to the memory MB, and may transmit the received input signals to the logic circuit LC. Accordingly, the interface circuit CI may be at the bottom center in the floor plan considering transmission efficiency.

The analog circuit AC may receive a voltage from the outside, and generate power voltages to be used by the logic circuit LC, the memory MB, the data driver DDRV, and the gate driver GDRV. To generate a power voltage required in each circuit, various power supply circuits such as a regulator and a DC/DC converter may be included.

The data driver DDRV may receive the image signals and control signals from the memory MB and the logic circuit LC, respectively, and generate driving signals to be applied to data lines of a display panel. The data driver DDRV may output driving signals to the data lines of the display panel (for example, the first through $m^{th}$ data lines DL1 through DLm in FIG. 1) via the output pad PO.

The logic circuit LC may receive an input signal from the interface circuit CI, generate a control signal for driving the display panel based on the input signal, and transmit the control signal to the memory MB, the data driver DDRV, and the gate driver GDRV. Accordingly, the logic circuit LC may be in the center portion on the floor plan considering transmission efficiency.

The logic circuit LC may include a crack detector CD, as well as a crack sensing line. The crack detector CD may detect a crack in the crack sensing line formed in the boundary area BAe. The crack detector CD and crack sensing line may include one of the crack detector 140 in FIG. 2, the crack detector 140*a* in FIG. 7, the first crack detector 140*b*1 and the second crack detector 140*b*2 in FIG. 9, the crack detector 140*c* in FIG. 10, and the crack detector 140*d* in FIG. 11. The crack sensing line may be one of the crack sensing lines described in connection with these figures.

The display driving circuit 100*e* may include a substrate having the various above-mentioned pads and circuits formed from a plurality of layers formed thereon, and having the crack detection circuit and crack sensing line formed thereon.

The memory MB may receive the control signal from the logic circuit LC, and output the image signal to the data driver DDRV.

Figure 14:
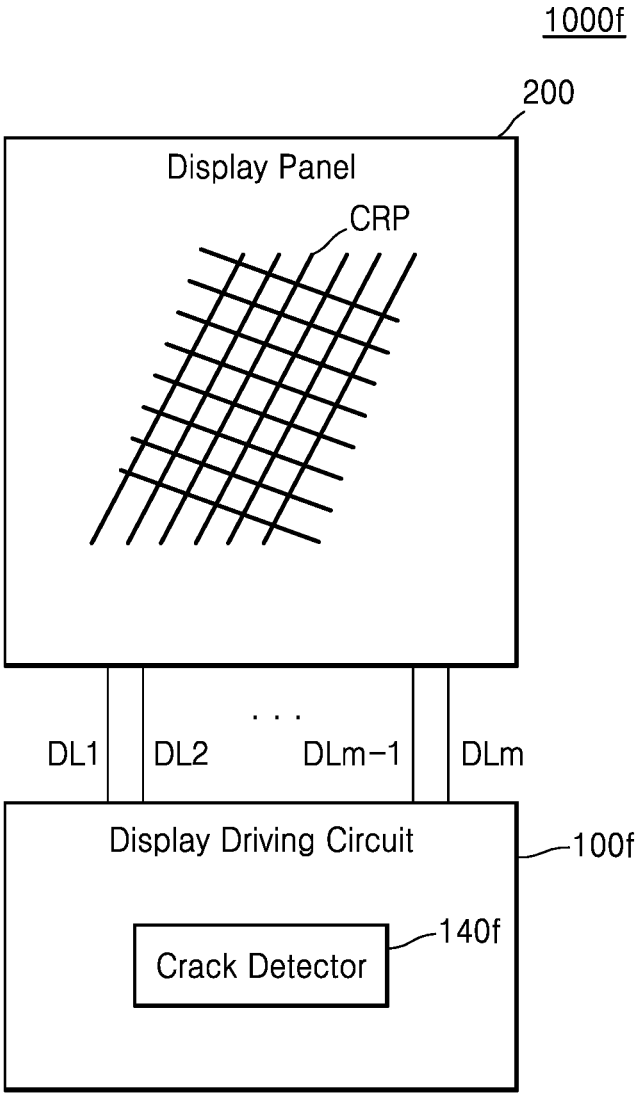
FIG. 14 is a diagram of a display device according to an example embodiment of the inventive concept.

FIG. 14 is a diagram of a display device 1000*f* according to an example embodiment of the inventive concept.

Referring to FIG. 14, the display device 1000*f* may include a display driving circuit 100*f* and a display panel 200. The display driving circuit 100*f* may include a crack detector 140*f*, and the crack detector 140*f* may detect cracks formed in a boundary area thereof. When a crack is detected, the display driving circuit 100*f* may provide driving signals to the pixels PX included in the display panel 200 via the first through $m^{th}$ data lines DL1 through DLm so that a preset crack pattern CRP is displayed on the display panel 200. Accordingly, the display device 1000*f* may display a state of the display driving circuit 100*f* due to a crack, that is, a normal state or a poor state, by using the crack pattern CRP. The preset crack pattern CRP may be displayed near an edge of the display panel in one embodiment, to minimize obstructing other information appearing on the display panel.

Figure 15:
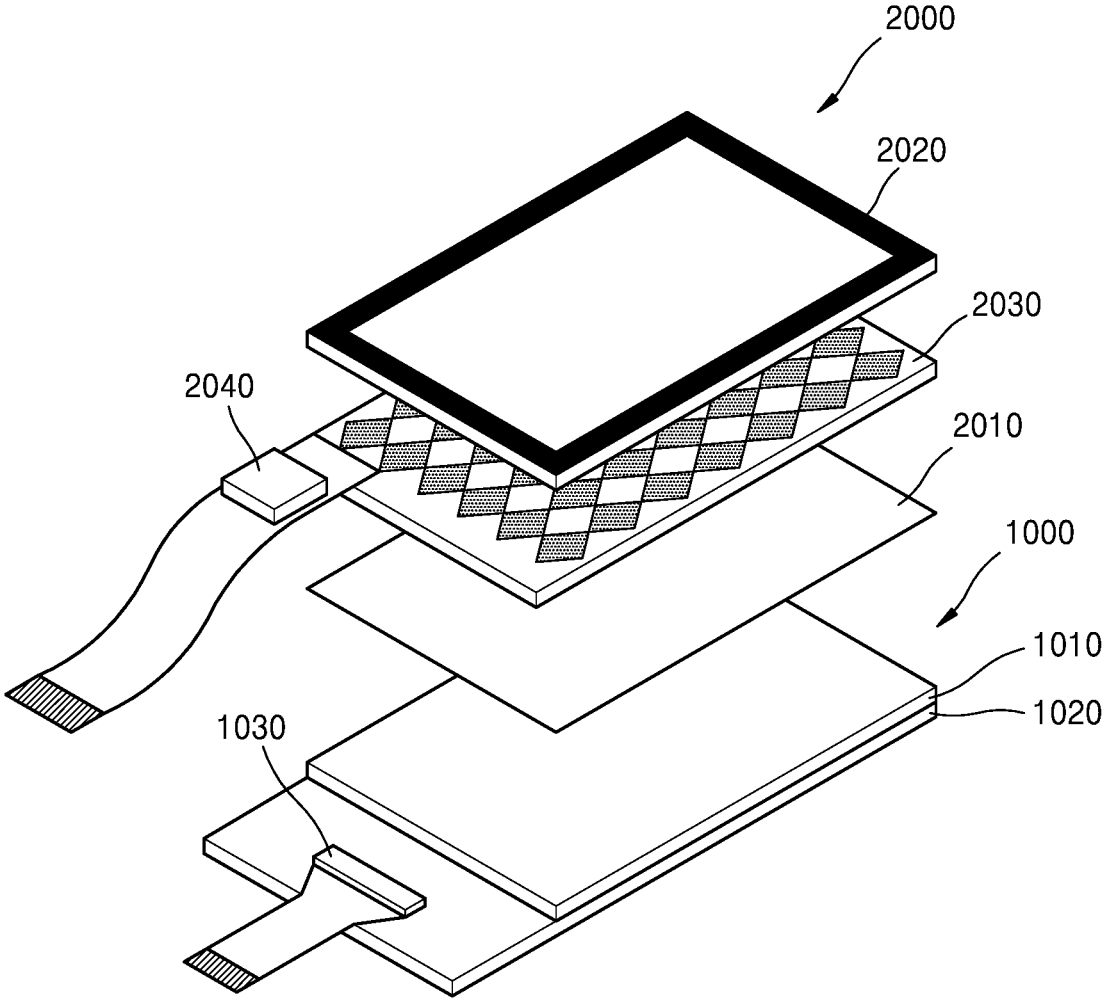
FIG. 15 is a diagram illustrating a touch screen module according to an example embodiment of the inventive concept.

FIG. 15 is a diagram illustrating a touch screen module 2000 according to an example embodiment of the inventive concept.

Referring to FIG. 15, the touch screen module 2000 may include the display device 1000, a polarizing plate 2010, a touch panel 2030, a touch controller 2040, and a window glass 2020. The display device 1000 may include a display panel 1010, a printed circuit board (PCB) 1020, and a display driving circuit 1030. The display device 1000 may include the display devices 1000 or 1000*f* according to embodiments of the inventive concept described with reference to FIG. 1 or 14, respectively. The touch screen module may be a touch screen module for a mobile phone, or tablet device, for example.

The window glass 2020 may be manufactured with a material such as acrylic and tempered glass, and may protect the touch screen module 2000 from external shocks or scratches caused by repeated touches. The polarizing plate 2010 may be provided to improve optical characteristics of the display panel 1010. The display panel 1010 may be formed by patterning a transparent electrode on the PCB 1020. The display panel 1010 may include a plurality of pixels PX for displaying a frame. The display driving circuit 1030 may include one of the display driving circuits 100, 100*a*, 100*b*, 100*c*, 100*d*, 100*e*, and 100*f* according to embodiments of the inventive concept described with reference to FIGS. 1 through 14. The display driving circuit 1030 may, by detecting an internal crack, output information about whether a crack has occurred to the outside, and may output the location information about the crack occurrence.

The touch screen module 2000 may further include the touch panel 2030 and the touch controller 2040. The touch panel 2030 may be formed by patterning a transparent electrode such as Indium Tin Oxide (ITO) on a glass substrate or a polyethylene terephthlate (PET) film. In an example embodiment, the touch panel 2030 may be on the display panel 1010. For example, pixels of the touch panel 2030 may be formed by being merged with the pixels PX of the display panel 1010. The touch controller 2040 may detect a touch occurrence on the touch panel 2030, calculate touch coordinates, and transmit the touch coordinates to the host. The touch controller 2040 and the display driving circuit 1030 may be integrated in one semiconductor chip.

It will be understood that, although the terms first, second, third etc. may be used herein to describe various elements, components, regions, layers and/or sections, these elements, components, regions, layers and/or sections should not be limited by these terms. Unless the context indicates otherwise, these terms are only used to distinguish one element, component, region, layer or section from another element, component, region, layer or section, for example as a naming convention. Thus, a first element, component, region, layer or section discussed below in one section of the specification could be termed a second element, component, region, layer or section in another section of the specification or in the claims without departing from the teachings of the present invention. In addition, in certain cases, even if a term is not described using "first," "second," etc., in the specification, it may still be referred to as "first" or "second" in a claim in order to distinguish different claimed elements from each other.

While the inventive concept has been particularly shown and described with reference to embodiments thereof, it will be understood that various changes in form and details may be made therein without departing from the spirit and scope of the following claims.

What is claimed is:

1. A display driving circuit comprising a central area and a boundary area surrounding the central area, the display driving circuit comprising:

an input pin configured to receive a test command from the outside of the display driving circuit;

a crack detector circuit configured to receive the test command from the input pin and generate a test result signal in response to the test command;

a first crack sensing line in the boundary area and including a first end and a second end connected to the crack detector circuit; and an output pin configured to output the test result signal received from the crack detector circuit to the outside of the display driving circuit;

wherein the first crack sensing line is separated from the input pin and the output pin.

2. The display driving circuit of claim 1, wherein the crack detector circuit is configured to:

transmit a first test signal to the first end of the first crack sensing line, receive a first reception signal from the second end of the first crack sensing line, and output the test result signal according to a result of comparing the first test signal with the first reception signal.

3. The display driving circuit of claim 2, wherein the crack detector circuit comprises:

a pulse generator circuit configured to generate the first test signal toggling between a high level and a low level at a certain period; and a pulse detector circuit configured to set a result of comparing the first test signal with the first reception signal as a crack flag in a register.

4. The display driving circuit of claim 2, further comprising a second crack sensing line formed in the boundary area and electrically apart from the first crack sensing line, wherein the crack detector circuit is configured to:

transmit a second test signal to a first end of the second crack sensing line in response to the test command, receive a second reception signal from a second end of the second crack sensing line, and output the test result signal according to a result of comparing the second test signal with the second reception signal.

5. The display driving circuit of claim 4, wherein the crack detector circuit comprises:

a pulse generator circuit configured to generate the first test signal and the second test signal toggling between a high level and a low level at a certain period; and a pulse detector circuit configured to set a result of comparing the first test signal with the first reception signal, and a result of comparing the second test signal with the second reception signal as crack flags in a register, wherein the pulse detector circuit stores location information about crack occurrence based on the first reception signal and the second reception signal.

6. The display driving circuit of claim 1, further comprising second through fourth crack sensing lines formed in the boundary area, electrically apart from the first crack sensing line, and apart from each other, wherein the crack detector circuit is configured to detect cracks in the second through fourth crack sensing lines in response to the test command, and to output the test result signal comprising information about a presence or an absence of cracks in the second through fourth crack sensing lines.

7. The display driving circuit of claim 1, further comprising:

a substrate; and a plurality of layers stacked on the substrate, each of the plurality of layers comprising conductive patterns formed therein, wherein the first crack sensing line is formed by a conductive pattern formed in only one layer among the plurality of layers.

8. The display driving circuit of claim 1, further comprising:

a substrate; and a plurality of layers stacked on the substrate, a group of layers of the plurality of layers comprising conductive patterns formed therein, wherein the first crack sensing line comprises conductive patterns formed in each layer of the group of layers and via patterns connecting the conductive patterns formed in different layers from each other, and at least some of the conductive patterns comprising the first crack sensing line overlap each other in a direction perpendicular to the substrate.

9. The display driving circuit of claim 1, further comprising:

a substrate; and a plurality of layers stacked on the substrate, a group of layers of the plurality of layers comprising conductive patterns formed therein, wherein the first crack sensing line comprises conductive patterns formed on each layer of the group of layers and via patterns connecting the conductive patterns formed on different layers from each other, and the first end of the first crack sensing line and the second end of the first crack sensing line overlap each other in a direction perpendicular to the substrate.

10. The display driving circuit of claim 1, further comprising:

a data driving circuit providing driving signals to a plurality of data lines connected to a plurality of pixels of a display panel; and a logic circuit configured to control the data driving circuit and comprising the crack detector circuit, wherein the data driving circuit and logic circuit are arranged in the central area.

11. A display driving circuit comprising a central area and a boundary area surrounding the central area, the display driving circuit comprising:

a first crack sensing line in the boundary area; and a first crack detector circuit disposed in the central area and configured to generate a first test result signal according to whether the first crack sensing line is cracked in response to a first test command, wherein the first crack detector circuit is configured to:

receive the first test command through a first pin of the first crack detector circuit, output a first test signal to a first end of the first crack sensing line through a second pin of the first crack detector circuit, receive a first reception signal from a second end of the first crack sensing line through a third pin of the first crack detector circuit, and output the first test result signal through a fourth pin of the first crack detector circuit.

12. The display driving circuit of claim 11, further comprising a second crack sensing line in the boundary area and electrically apart from the first crack sensing line, wherein the first crack detector circuit is configured to detect cracks in the first crack sensing line and the second crack sensing line in response to the first test command, and output the first test result signal including information about a presence or an absence of cracks in the first crack sensing line and the second crack sensing line.

13. The display driving circuit of claim 12, wherein the first crack sensing line and the second crack sensing line are symmetrical with respect to each other.

14. The display driving circuit of claim 13, wherein the first crack detector circuit, in response to a second test command, outputs a location information signal comprising location information about a crack sensing line where a crack has occurred among the first crack sensing line and the second crack sensing line.

15. The display driving circuit of claim 11, wherein the first crack detector circuit comprises:

a pulse generator circuit configured to generate the first test signal toggling between a high level and a low level at a certain period and output the first test signal to the first end of the first crack sensing line; and a pulse detector circuit receiving the first reception signal from the second end of the first crack sensing line and being configured to output a result of comparing the first test signal with the first reception signal as the first test result signal.

16. The display driving circuit of claim 11, further comprising:

a second crack detector circuit arranged in the central area; and a second crack sensing line in the boundary area and electrically apart from the first crack sensing line, wherein the second crack detector circuit is configured to:

transmit a second test signal to a first end of the second crack sensing line, detect a crack in the second crack sensing line in response to the first test command, and output a test result signal comprising information about a presence or an absence of a crack in the second crack sensing line.

17. A display device comprising:

a display panel comprising a plurality of pixels arranged in rows and columns; and a display driving circuit configured to provide a driving signal to a plurality of data lines connected to the plurality of pixels, and comprising a crack detector circuit and at least one crack sensing line, wherein the crack detector circuit is configured to:

transmit a test signal to a first end of the at least one crack sensing line, receive a reception signal from a second end of the at least one crack sensing line, and output a test result signal according to a result of comparing the test signal with the reception signal to the outside of the display driving circuit.

18. The display driving circuit of claim 17, wherein the at least one crack sensing line comprises a plurality of crack sensing lines electrically apart from each other.

19. The display device of claim 17, wherein, when a crack is detected by the crack detector circuit, the display driving circuit provides a driving signal to the plurality of data lines to display a preset crack pattern.

20. The display device of claim 17, wherein the display driving circuit further comprises a data driving circuit configured to generate a driving signal to a plurality of data lines connected to the plurality of pixels, and a logic circuit controlling the data driving circuit, wherein the crack detector circuit, the data driving circuit, and the logic circuit are arranged in a central area of the display driving circuit, and wherein the crack sensing line is arranged in a boundary area surrounding the central area.

* * * * *